US011682833B2

(12) United States Patent
Wang et al.

(10) Patent No.: US 11,682,833 B2
(45) Date of Patent: Jun. 20, 2023

(54) ANTENNA, PREPARATION METHOD THEREOF AND ELECTRONIC DEVICE

(71) Applicant: BOE Technology Group Co., Ltd., Beijing (CN)

(72) Inventors: Feng Wang, Beijing (CN); Ziyu Zhang, Beijing (CN); Wei Wang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 44 days.

(21) Appl. No.: 17/343,767

(22) Filed: Jun. 10, 2021

(65) Prior Publication Data

US 2022/0102851 A1 Mar. 31, 2022

(30) Foreign Application Priority Data

Sep. 28, 2020 (CN) ..... 202011043726.5

(51) Int. Cl.
*H01Q 1/44* (2006.01)
*H01Q 1/38* (2006.01)
*H01Q 9/04* (2006.01)

(52) U.S. Cl.
CPC ..... *H01Q 1/44* (2013.01); *H01Q 1/38* (2013.01); *H01Q 9/0471* (2013.01)

(58) Field of Classification Search
CPC ..... H01Q 1/44; H01Q 1/38; H01Q 9/0471; H01Q 13/28; H01Q 1/36
See application file for complete search history.

(56) References Cited

U.S. PATENT DOCUMENTS 8,570,240 B2 * 10/2013 Tanaka ..... H04B 13/00 343/897
10,847,887 B2 * 11/2020 Tombs ..... H01Q 9/0407
11,271,282 B2 * 3/2022 Jang ..... G06F 1/1698
2009/0051620 A1 * 2/2009 Ishibashi ..... H01Q 9/16 343/897
2012/0287018 A1 * 11/2012 Parsche ..... H01L 31/042 29/601
2017/0352959 A1 12/2017 Sugita et al.

OTHER PUBLICATIONS

Alexis Martin et al., "Mesh parameters influence on transparent and active antennas performance at microwaves", AIP Advances 7, 085120, 1-8 (2017).
Junho Park et al., "An Optically Invisible Antenna-on-Display Concept for Millimeter-Wave 5G Cellular Devices", IEEE Transactions on Antennas and Propagation, May 2019, pp. 2942-2952, vol. 67, No. 5.

* cited by examiner

*Primary Examiner* — Seung H Lee
(74) *Attorney, Agent, or Firm* — Ling Wu; Stephen Yang; Ling and Yang Intellectual Property

(57) ABSTRACT

An antenna is provided. The antenna includes a transparent substrate and a metal layer disposed on the transparent substrate. The metal layer includes a plurality of hollow regions, at least one hollow region in the plurality of hollow regions is surrounded by at least one metal line group and the at least one metal line group includes at least one metal line; a cross section of the at least one metal line has a non-rectangular shape.

17 Claims, 13 Drawing Sheets

ANTENNA, PREPARATION METHOD THEREOF AND ELECTRONIC DEVICE

CROSS-REFERENCE TO RELATED APPLICATION

The present application claims the priority of Chinese Patent Application No. 202011043726.5 filed to the CNIPA on Sep. 28, 2020, the content of which is incorporated herein by reference.

TECHNICAL FIELD

The embodiments of the disclosure relate to the technical field of communication, in particular to an antenna, a preparation method thereof and an electronic device.

BACKGROUND

With the development of wireless communication technology, mobile communication products have also developed rapidly. Mobile communication products may implement a function of data transmission and achieve a purpose of resource sharing. In mobile communication products, an antenna is one of the necessary components. An antenna is a kind of converter, which transforms guided waves transmitted on a transmission line into electromagnetic waves transmitted in an unbounded medium (usually free space), or vice versa. The antenna may implement functions of transmitting or receiving electromagnetic waves, and it is widely used in many fields such as communication, radar, navigation, broadcasting, television, remote sensing, radio astronomy, etc.

SUMMARY

The following is a summary of subject matter described in detail herein. This summary is not intended to limit the protection scope of the claims.

Embodiments of the present disclosure provide an antenna, a preparation method thereof and an electronic device.

On one hand, the embodiment of the disclosure provides an antenna including a transparent substrate and a metal layer disposed on the transparent substrate. The metal layer includes a plurality of hollow regions, at least one hollow region in the plurality of hollow regions is surrounded by at least one metal line group, and the at least one metal line group includes at least one metal line; a cross section of the at least one metal line has a non-rectangular shape.

In some exemplary embodiments, the transparent substrate has a plurality of non-planar structures, and a cross section of at least one of the plurality of non-planar structures has a shape of gradually decreasing width along a direction away from a surface of the transparent substrate.

In some exemplary embodiments, the at least one non-planar structure is a concave structure or a convex structure.

In some exemplary embodiments, the at least one metal line covers the at least one non-planar structure.

In some exemplary embodiments, a cross section of at least one non-planar structure of the transparent substrate is in a wedge-like shape, and a cross section of the at least one metal line is in an epaulet shape.

In some exemplary embodiments, a ratio of a maximum vertical distance between a surface of the at least one non-planar structure of the transparent substrate and a surface of the transparent substrate to a width of the at least one metal line is at least greater than 0.5.

In some exemplary embodiments, the maximum vertical distance between the surface of the at least one non-planar structure of the transparent substrate and the surface of the transparent substrate ranges from 2 microns to 25 microns, and the width of the at least one metal line ranges from 1 micron to 10 microns.

In some exemplary embodiments, the at least one metal line group includes at least two metal lines, and spacing between adjacent metal lines in the at least one metal line group is greater than or equal to 0.2 microns.

In some exemplary embodiments, the at least one metal line group includes at least two metal lines, inclined directions of adjacent metal lines in the at least one metal line group are parallel to each other on a direction perpendicular to the transparent substrate, and a projection of at least one metal line in the at least one metal group on the transparent substrate is partially overlapped with a projection of the at least one non-planar structure on the transparent substrate.

In some exemplary embodiments, a cross section of at least one non-planar structure of the transparent substrate is V-shaped or inverted V-shaped, and a cross section of the at least one metal line is a parallelogram.

In some exemplary embodiments, spacing between adjacent metal lines in at least one metal line group is greater than 1 micron.

In some exemplary embodiments, the antenna further includes an organic layer covering the metal layer.

In some exemplary embodiments, the transparent substrate is a glass substrate.

In some exemplary embodiments, the at least one hollow region has a rectangular shape, a rhombic shape or a polygonal shape.

On the other hand, an embodiment of the present disclosure provides an electronic device including any of the antennas described above.

On the other hand, the embodiment of the disclosure provides a preparation method for an antenna, which includes the following steps: providing a transparent substrate; forming a metal layer on the transparent substrate, wherein the metal layer includes a plurality of hollow regions, and at least one hollow region in the plurality of hollow regions is surrounded by at least one metal line group which includes at least one metal line, and a cross section of the at least one metal line is non-rectangular.

In some exemplary embodiments, the transparent substrate is a glass substrate. Wherein providing the transparent substrate includes etching a plurality of non-planar structures on the glass substrate in a mixed mode of dry etching and wet etching, wherein a cross section of at least one non-planar structure in the plurality of non-planar structures is in a shape of gradually decreasing width along a direction away from a surface of the transparent substrate.

In some exemplary embodiments, forming the metal layer on the transparent substrate includes depositing a metal thin film on a part of region of at least one non-planar structure of the transparent substrate by use of a mask to form a metal layer, wherein at least one metal line group of the metal layer includes at least two metal lines, and inclined directions of adjacent metal lines in the at least one metal line group are parallel to each other on a direction perpendicular to the transparent substrate.

Other aspects will be understood after the drawings and the detailed description are read and understood.

BRIEF DESCRIPTION OF DRAWINGS

The attached drawings are for providing a further understanding of the technical solutions of the present disclosure and constitute a part of the description. They are for explaining the technical solutions of the present disclosure together with the embodiments of the present application and do not constitute a limitation on the technical solutions of the present disclosure. Shapes and sizes of one or more components in the accompanying drawings do not reflect real scales, and are only for a purpose of schematically illustrating contents of the present disclosure.

DETAILED DESCRIPTION

Figure 1:
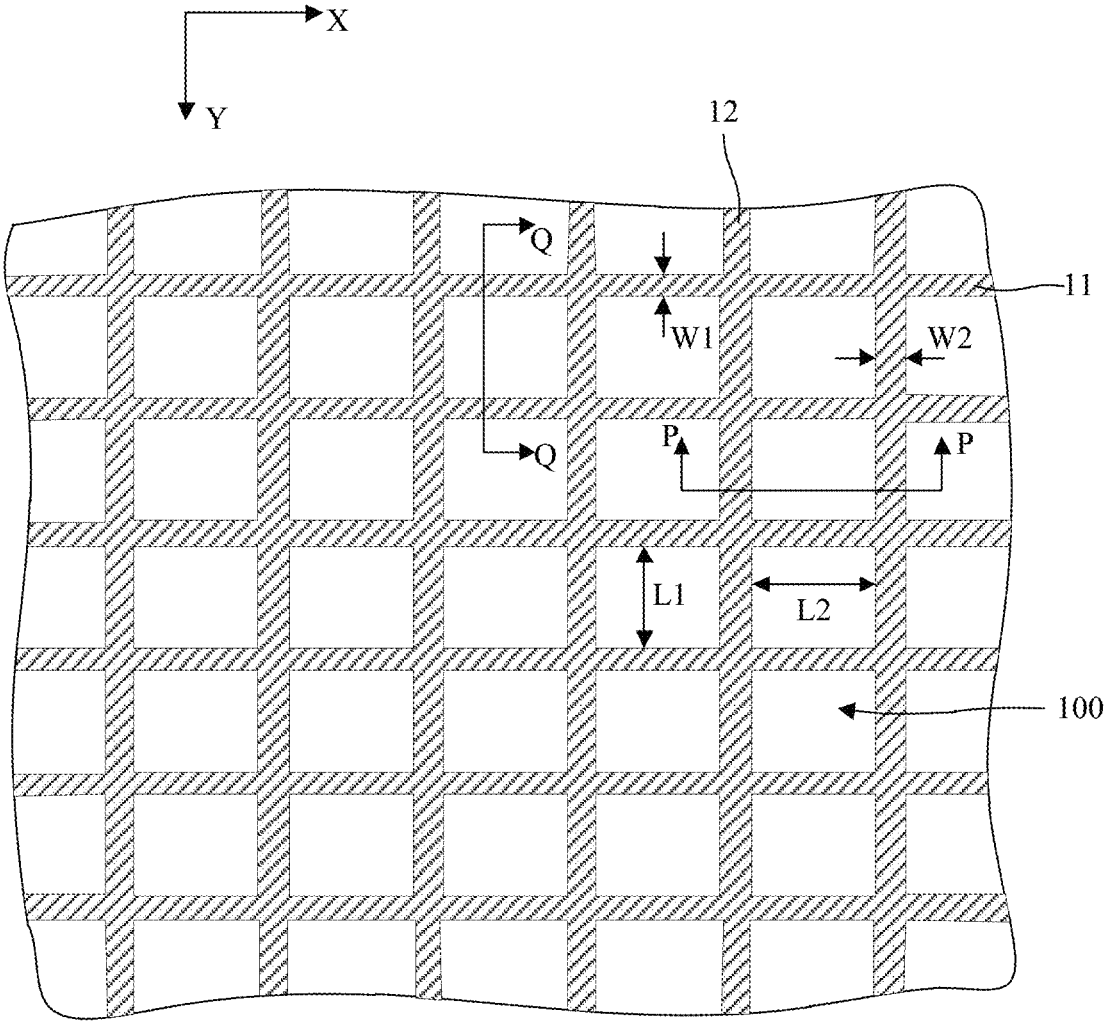
FIG. 1 is a top view of a transparent antenna.

Embodiments of the present disclosure will be described in detail hereinafter with reference to the accompanying drawings. The embodiments may be implemented in a number of different forms. Those of ordinary skills in the art will readily understand the fact that implementations and contents may be transformed into one or more of forms without departing from the spirit and scope of the present disclosure. Therefore, the present disclosure should not be construed as being limited only to what is described in the following embodiments. The embodiments and features in the embodiments in the present disclosure may be combined randomly if there is no conflict.

In the drawings, sizes of one or more constituent elements, or thicknesses or regions of layers, are sometimes exaggerated for clarity. Therefore, an implementation of the present disclosure is not necessarily limited to the size shown, and a shape and size of each component in the drawings do not reflect true proportions. In addition, the drawings schematically show ideal examples, and an implementation of the present disclosure is not limited to the shapes or values shown in the drawings.

The "first", "second", "third" and other ordinal numbers in the present disclosure are used to avoid confusion of constituent elements, not to provide any quantitative limitation. In the description of the present disclosure, term "a plurality of" means two or more counts.

In the present disclosure, for the sake of convenience, words such as "central", "upper", "lower", "front", "rear", "vertical", "horizontal", "top", "bottom", "inner", "outer" and the others describing the orientations or positional relations are used to depict positional relations of elements with reference to the drawings, which are only for an easy and simplified description of the present disclosure, rather than for indicating or implying that the device or element referred to must have a specific orientation, or must be constructed and operated in a particular orientation and therefore, those words may not be construed as limitations on the present disclosure. The positional relations of the constituent elements may be appropriately changed according to the direction in which constituent elements are described. Therefore, they are not limited to the wordings in the specification, and may be replaced appropriately according to the situations.

In the present disclosure, the terms "installed", "connected" and "coupled" shall be understood in their broadest sense unless otherwise explicitly specified and defined. For example, a connection may be a fixed connection, or may be a detachable connection, or an integrated connection; it may be a mechanical connection, or may be an electrical connection; it may be a direct connection, or may be an indirect connection through middleware, or may be an internal connection between two elements. Those of ordinary skills in the art may understand the specific meanings of the above terms in the present disclosure according to situations.

In the present disclosure, "an electrical connection" includes a case where constituent elements are connected via an element having a certain electrical action. The "element having a certain electrical action" is not particularly limited as long as it may transmit and receive electrical signals between connected constituent elements. Examples of the "element having a certain electrical action" not only include electrodes and wirings, but also include switching elements such as transistors, resistors, inductors, capacitors, and other elements with one or more functions.

In the present disclosure, "parallel" refers to a state in which an angle formed by two straight lines is above −10 degrees and below 10 degrees, and thus may include a state in which the angle is above −5 degrees and below 5 degrees. In addition, "perpendicular" refers to a state in which an angle formed by two straight lines is above 80 degrees and below 100 degrees, and thus may include a state in which the angle is above 85 degrees and below 95 degrees.

In the present disclosure, "film" and "layer" are interchangeable. For example, sometimes "conductive layer" may be replaced by "conductive film". Similarly, "insulating film" may sometimes be replaced by "insulating layer".

"About" in the present disclose means that limits of a value are not limited strictly, and values within ranges of process and measurement errors are allowed.

In this disclosure, "thickness" is a dimension of a film layer in a direction perpendicular to a substrate.

The "transmittance" in the present disclosure refers to an ability of light to pass through a medium, and is a percentage of the luminous flux passing through a transparent or translucent body to its incident luminous flux.

An antenna with good concealment performance has outstanding design advantages in applications such as smart buildings, artificial microsatellites, vehicle-mounted communication equipment, and the fifth generation mobile communication technology (5G) mobile terminals. Especially at present, mobile terminals (such as mobile phones) are developing towards directions of ultra-thin design, full-screen and being compatible with a series of communication functions such as 5G/the fourth generation mobile communication technology (4G)/the third generation mobile communication technology (3G), WiFi, Near Field Communication (NFC), etc., so the design space reserved for the antenna is extremely limited. By designing an antenna with good concealment performance, the above situation of tight design space may be alleviated. At present, transparent oxide conductive materials, such as Indium Tin Oxide (ITO), or multi-layer film materials of metal and conductive oxide, or metal mesh films, are commonly used to achieve transparent antenna design.

Figure 2A:
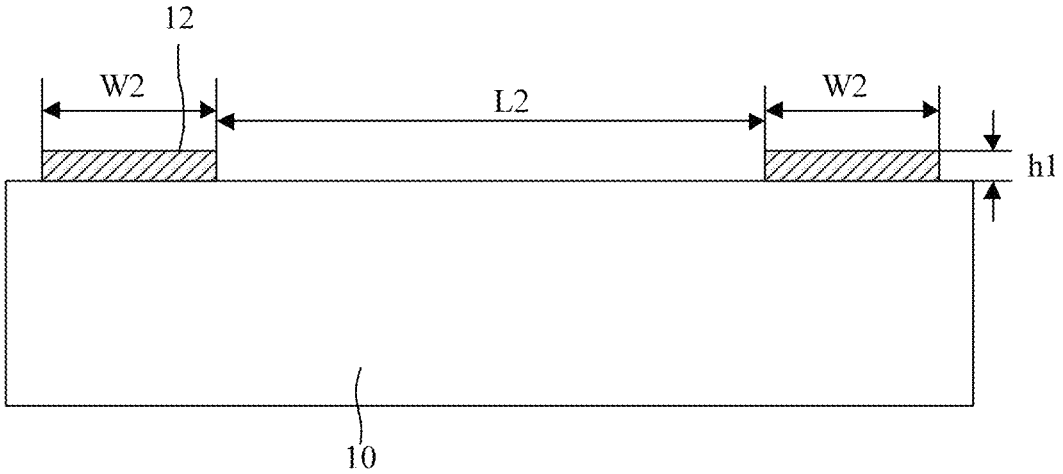
FIG. 2A is a schematic sectional view along P-P direction in FIG. 1.
Figure 2B:
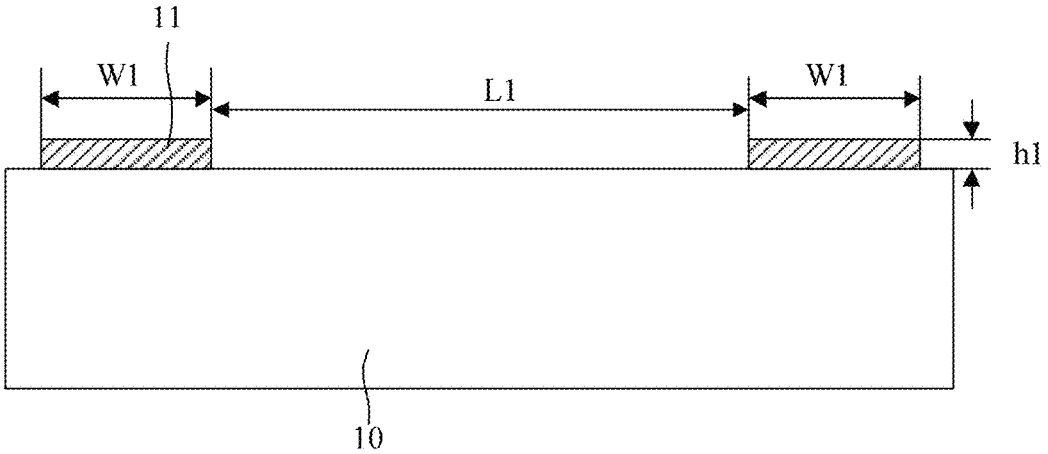
FIG. 2B is a schematic sectional view along Q-Q direction in FIG. 1.

FIG. 1 is a top view of a transparent antenna. FIG. 2A is a schematic sectional view along P-P direction in FIG. 1; FIG. 2B is a schematic sectional view along Q-Q direction in FIG. 1; As shown in FIGS. 1, 2A and 2B, the transparent antenna includes a transparent substrate 10 and a metal layer disposed on the transparent substrate 10. As shown in FIG. 1, on a direction parallel to the transparent substrate 10, the metal layer of the transparent antenna includes a plurality of first metal lines 11 parallel to each other and a plurality of second metal lines 12 parallel to each other. The plurality of first metal lines 11 extend along a first direction (X direction as shown in FIG. 1), and the plurality of second metal lines 12 extend along a second direction (Y direction as shown in FIG. 1), and the first direction is perpendicular to the second direction. The plurality of first metal lines 11 and the plurality of second metal lines 12 intersect to form a plurality of first hollow regions 100, which may expose the transparent substrate 10. The first hollow region 100 in FIG. 1 is illustrated as a rectangle. Each first hollow region 100 is surrounded by two adjacent first metal lines 11 and two adjacent second metal lines 12. Light may pass through the first hollow region 100 of the metal layer of the transparent antenna, thereby ensuring light transmittance of the transparent antenna. In some examples, the first metal line 11 has a first line width W1, the second metal line 12 has a second line width W2, and the rectangular first hollow region 100 surrounded by the first metal line 11 and the second metal line 12 has a first side length L1 along the Y direction and a second side length L2 along the X direction, so that the light transmittance of the transparent antenna is $$\frac{L1 \times L2}{(L1 + W1) \times (L2 \times W2)}.$$

In order to ensure that human eyes may not distinguish metal lines visually, so as to achieve an unobstructed effect, a line width of a single metal line (e.g., the first line width W1 or the second line width W2) needs to be lower than a limit size of distinct vision, so that it may not be distinguished by human eyes. The limit size of distinct vision is mainly based on the diffraction resolution limit theorem, that is, Rayleigh Criterion. For pupil diameters of human eyes, assuming that a distance of distinct vision is 25 centimeters (cm), a resolution limit of human eyes is about 100 microns. Therefore, in order to achieve the unobstructed effect, the line width of a metal line may be set to less than 100 microns.

As shown in FIGS. 2A and 2B, the transparent substrate 10 has a flat upper surface on a direction perpendicular to the transparent substrate 10, and the first metal line 11 and the second metal line 12 are located on the flat upper surface of the transparent substrate 10. The cross sections of the first metal line 11 and the second metal line 12 are rectangular. Both the first metal line 11 and the second metal line 12 have a first thickness h1. The first thickness h1 may be thinner than a metal skin depth in a microwave band, but in order to ensure smaller microwave impedance, the first thickness h1 is usually at least one to three times the skin depth of a metal material in a microwave band or a millimeter wave band. For example, for silver, a skin depth at about 5 GHz is 0.6 microns to 0.7 microns. Therefore, a thickness of a metal line made of silver may usually be about 2 microns.

In the above transparent antenna, the plurality of first metal lines and the plurality of second metal lines of the metal layer may block part of incident light, thereby reducing the light transmittance of the transparent antenna, and a conductivity may be reduced in the first hollow region of the metal layer and the impedance may be increased. Although increasing line widths of metal lines may effectively increase conductivities and reduce the impedance, increasing line widths of metal lines will block more light, resulting in a decrease in light transmittance. Therefore, it is impossible for the transparent antenna to balance increasing the light transmittance and reducing the impedance loss.

At least one embodiment of the present disclosure provides an antenna including a transparent substrate and a metal layer disposed on the transparent substrate. The metal layer includes a plurality of hollow regions, at least one hollow region in the plurality of hollow regions is surrounded by at least one metal line group which includes at least one metal line, the at least one metal line has a non-rectangular cross section.

According to the antenna provided in this embodiment, the impedance loss may be reduced by disposing the hollow region surrounded by at least one group of metal lines, and the light transmittance of the antenna may be increased by disposing the cross section of the metal lines surrounding the hollow region to be non-rectangular.

In some exemplary embodiments, the at least one hollow region may be rectangular, rhombic or polygonal. However, a shape of the hollow region is not limited in this embodiment.

In some exemplary embodiments, the transparent substrate has a plurality of non-planar structures, and a cross section of at least one of the plurality of non-planar structures has a shape whose width gradually decreases along a direction away from a surface of the transparent substrate. However, this is not limited in the present embodiment. In some examples, the cross section of the at least one non-planar structure may have a shape whose width gradually increases in the direction away from the surface of the transparent substrate. In this exemplary embodiment, a cross sectional shape of the metal line of the metal layer is changed by forming a non-planar structure on the transparent substrate. In some examples, the non-planar structure may be a convex structure or a concave structure. Wherein, the convex structure may include protrusions and the concave structure may include grooves. However, this is not limited in the present embodiment. In some examples, metal lines with non-rectangular cross sections may be formed on a flat transparent substrate. For example, metal lines with inverted trapezoidal cross sections may be formed on a flat transparent substrate.

In some exemplary embodiments, at least one metal line covers at least one non-planar structure. For example, if a non-planar structure is a groove, a metal line may fill and cover the groove; if a non-planar structure is a protrusion, a metal line may cover the protrusion. In some examples, when the non-planar structure is a groove, the metal line may form a steep reflection plane at the bottom by filling the groove, which is beneficial for the incident light to pass through the metal layer after being incident from the transparent substrate and reflected by the metal line, thereby improving the light transmittance of the antenna.

In some exemplary embodiments, at least one non-planar structure is a concave structure, a cross section of at least one non-planar structure of the transparent substrate is wedge-like shaped, and a cross section of at least one metal line covering the non-planar structure is epaulet-shaped. In some examples, wedge-like shapes may include shapes formed by an intersection of two gradually converging curves. An epaulet shape is a shape similar to an epaulet, for example, a bottom is formed by an intersection of two curves gradually converging, and a top is formed by an intersection of two curves gradually converging towards the bottom. However, this is not limited in the present embodiment. In some examples, the cross section of the non-planar structure may be inverted trapezoid or V-shaped, and the cross section of the metal line may be inverted trapezoid or inverted triangle.

In some exemplary embodiments, a ratio of a maximum vertical distance between a surface of the at least one non-planar structure of the transparent substrate and a surface of the transparent substrate to a width of the at least one metal line is at least greater than 0.5. In some exemplary embodiments, disposing the ratio of a maximum vertical distance between a surface of a non-planar structure of the transparent substrate and a surface of the transparent substrate to a width of a metal line at least greater than 0.5 is beneficial to increase a range of an incident angle of forward scattering of the incident light from the transparent substrate.

In some exemplary embodiments, the maximum vertical distance between the surface of the at least one non-planar structure of the transparent substrate and the surface of the transparent substrate ranges from 2 microns to 25 microns, and the width of the at least one metal line ranges from 1 micron to 10 microns. However, this is not limited in the present embodiment.

In some exemplary embodiments, at least one metal line group includes at least two metal lines, and spacing between adjacent metal lines in at least one metal line group is greater than or equal to 0.2 microns. In this exemplary embodiment, by disposing the spacing between the adjacent metal lines in the metal line group to be greater than or equal to 0.2 microns, it may be ensured that transversely polarized light in all visible light bands may pass through a gap between the adjacent metal lines, thereby increasing light throughput of the antenna.

In some exemplary embodiments, at least one metal line group includes at least two metal lines, in a direction perpendicular to the transparent substrate, inclined directions of adjacent metal lines in the at least one metal line group are parallel to each other, and a projection of at least one metal line in the at least one metal group on the transparent substrate is partially overlapped with a projection of the at least one non-planar structure on the substrate. In this exemplary embodiment, by disposing inclined directions of adjacent metal lines in the metal line group to be parallel to each other, an emitting direction of light passing through the metal line group may be consistent with a direction away from incident light, and a clear image point may be kept to be formed, which are suitable for a display system or an imaging system.

In some exemplary embodiments, a cross section of at least one non-planar structure of the transparent substrate is V-shaped or inverted V-shaped, and a cross section of at least one metal line is a parallelogram.

In some exemplary embodiments, spacing between adjacent metal lines in at least one metal line group is greater than 1 micron. In this exemplary embodiment, by disposing the spacing between the adjacent metal lines in the metal line group to be greater than 1 micron, optical diffraction and interference effects may be reduced, and an influence on display or imaging may be reduced.

In some exemplary embodiments, the antenna further includes an organic layer covering the metal layer. The organic layer may play a role in planarization and protecting the metal layer.

In some exemplary embodiments, the transparent substrate is a glass substrate, which is not limited in the present embodiment, though. For example, the transparent substrate may be a flexible substrate made of an organic material (e.g., polyimide).

The antenna according to this embodiment will be illustrated below through a number of examples.

Figure 3:
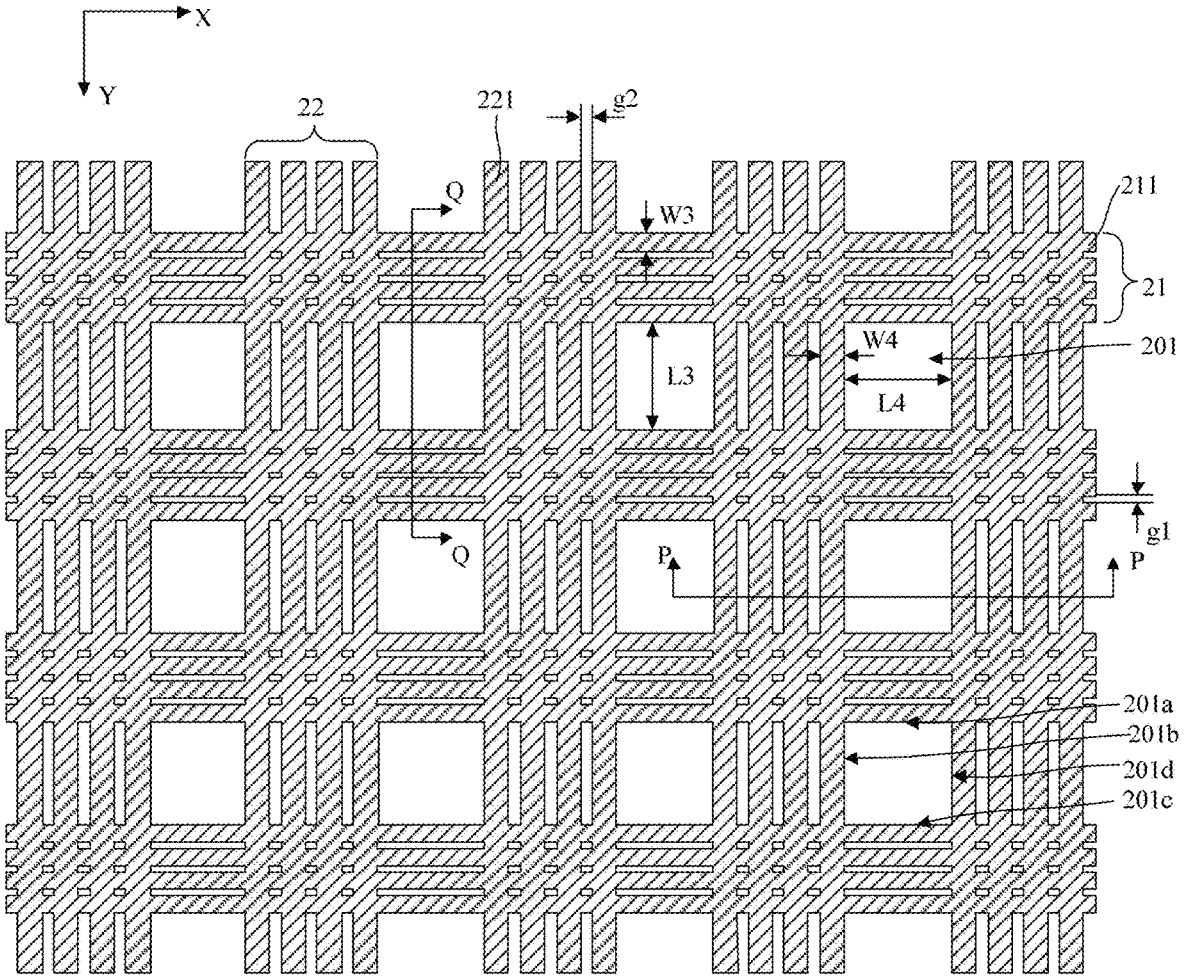
FIG. 3 is a top view of an antenna according to at least one embodiment of the disclosure.
Figure 4A:
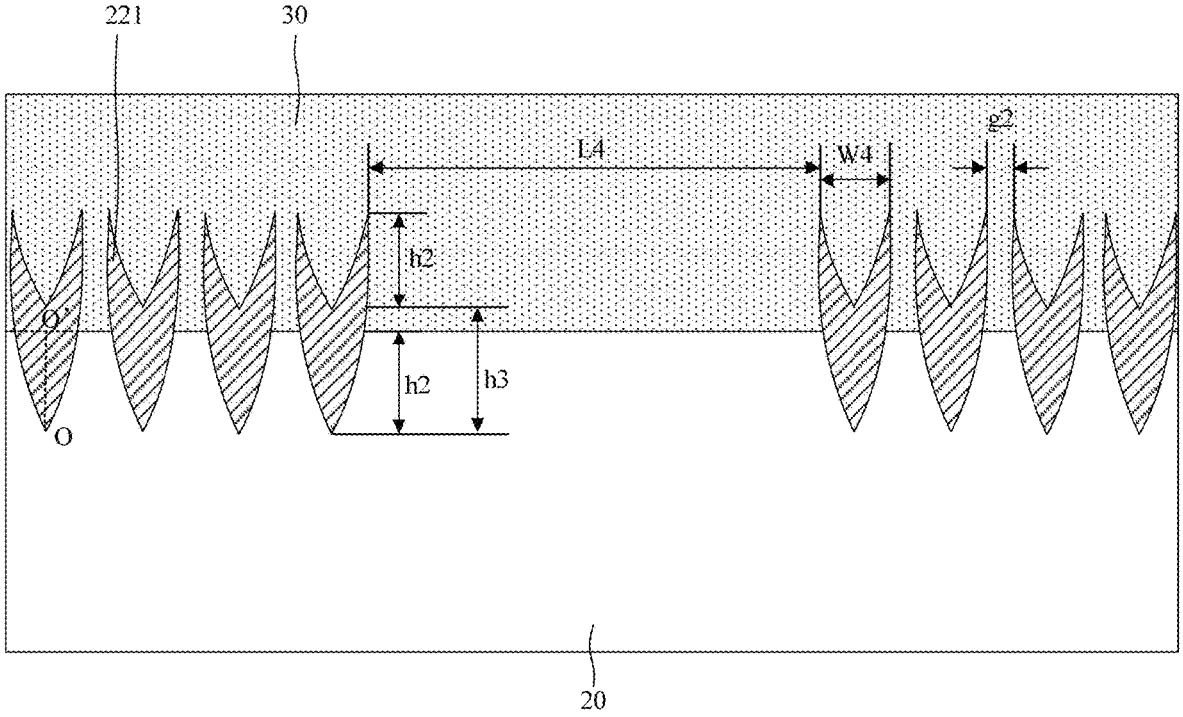
FIG. 4A is a schematic sectional view along P-P direction in FIG. 3.
Figure 4B:
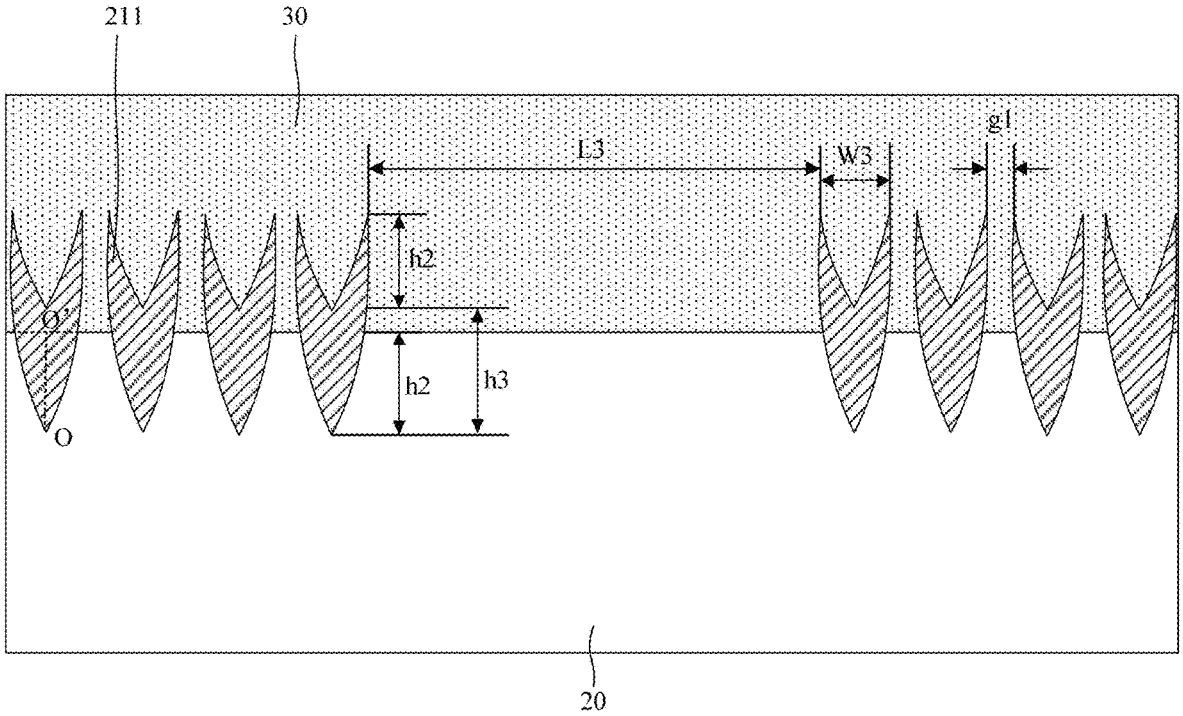
FIG. 4B is a schematic sectional view along Q-Q direction in FIG. 3.

FIG. 3 is a top view of an antenna according to at least one embodiment of the disclosure. FIG. 4A is a schematic sectional view along P-P direction in FIG. 3; FIG. 4B is a schematic sectional view along Q-Q direction in FIG. 3. The antenna shown in FIG. 3 may be applied to a non-display system or a non-imaging system. The antenna of this example may be a transparent antenna in a microwave band or a millimeter band. The antenna of this exemplary embodiment may increase light energy that may transmit through the antenna and reduce impedance loss in the microwave band or the millimeter band.

In some exemplary embodiments, as shown in FIG. 3, a metal layer of the antenna includes a plurality of second hollow regions 201 on a direction parallel to the transparent substrate. In this example, the second hollow region 201 is illustrated as a rectangle. However, a shape of the second hollow region is not limited in this embodiment. In some examples, the second hollow region may be triangular, rhombic, polygonal, or irregular in shape (e.g., a shape with curved edges).

In some exemplary embodiments, as shown in FIG. 3, the rectangular second hollow region 201 has a first side 201*a*, a second side 201*b*, a third side 201*c* and a fourth side 201*d*. The first side 201*a* is opposite to the third side 201*c* and the second side 201*b* is opposite to the fourth side 201*d*. The first side 201*a* and the third side 201*c* of the second hollow region 201 are surrounded by a third metal line group 21, and the second side 201*b* and the fourth side 201*d* of the second hollow region 201 are surrounded by a fourth metal line group 22. In other words, the second hollow region 201 is surrounded and formed by four metal line groups. The second hollow region 201 has a fourth side length L4 along a first direction (X direction as shown in FIG. 3) and a third side length L3 along a second direction (Y direction as shown in FIG. 3). As shown in FIG. 3, the third metal line group 21 includes four third metal lines 211 parallel to each other and extending along the X direction, and the fourth metal line group 22 includes four fourth metal lines 221 parallel to each other and extending along the Y direction.

However, the number of the third metal lines in the third metal line group and the number of the fourth metal lines in the fourth metal line group are not limited in this embodiment. For example, the number of third metal lines included in the third metal line group may be one, two, three, or five, and the number of fourth metal lines included in the fourth metal line group may be one, two, three, or five. In some examples, the number of third metal lines included in the third metal line group and the number of fourth metal lines included in the fourth metal line group may be different. For example, the third metal line group may include two third metal lines, and the fourth metal line group may include three fourth metal lines.

In some exemplary embodiments, as shown in FIG. 3, the third metal line 211 has a third line width W3 and the fourth metal line 221 has a fourth line width W4. The third line width W3 of the third metal line 211 and the fourth line width W4 of the fourth metal line 221 may be the same or different. However, this is not limited in the present embodiment. For example, line widths of a plurality of third metal lines in the third metal line group may be the same or different, and line widths of a plurality of fourth metal lines in the fourth metal line group may be the same or different.

In some exemplary embodiments, as shown in FIG. 3, there is a first spacing g1 between two adjacent third metal lines 211 in the third metal line group 21 and a second spacing g2 between two adjacent fourth metal lines 221 in the fourth metal line group 22. The first spacing g1 and the second spacing g2 may be the same or different. However, this is not limited in the present embodiment.

In some exemplary embodiments, as shown in FIGS. 4A and 4B, on a direction perpendicular to the transparent substrate, the antenna includes a transparent substrate 20, a metal layer with a plurality of second hollow regions, and an organic layer 30 covering the metal layer. The transparent substrate 20 may be a hard substrate (e.g., a glass substrate) or a flexible substrate (e.g., a substrate formed of organic materials such as polyimide). The organic layer 30 may be made of transparent organic materials, such as PET (Polyethylene terephthalate) materials, PVB (Polyvinyl Butyral) materials, COP (Cyclo Olefin Polymer) materials, acrylate resins, or transparent scratch-resistant or corrosion-resistant coatings with light transmittance above 90%. The organic layer 30 has effect of planarization and effect of protection on the metal layer. However, this is not limited in the present embodiment.

In some exemplary embodiments, as shown in FIGS. 4A and 4B, the transparent substrate 20 has a plurality of first grooves on a surface close to the metal layer on a direction perpendicular to the transparent substrate. As shown in FIG. 4A, point O is a bottom end of the first groove on the transparent substrate 20, and a maximum vertical distance (i.e., a maximum depth of the first groove) h2 between a surface of the first groove on the transparent substrate 20 and a surface of the transparent substrate 20 is a distance from point O to point O'. A width of a cross section of the first groove gradually decreases along a direction away from a surface of the transparent substrate. As shown in FIGS. 4A and 4B, the cross section of the first groove is in a wedge-like shape. Wherein, the cross section of the first groove is in a shape similar to a wedge. For example, the cross section of the first groove is formed by an intersection of two gradually converging curves, and the two curves protrude to an outside of the first groove. However, this is not limited in the present embodiment. In some examples, the cross section of the first groove may be other shapes whose width gradually decreases in a direction away from a surface of the transparent substrate, such as inverted trapezoid, V-shape, etc. Alternatively, the cross section of the first groove may have other shapes whose width gradually decreases in the direction away from the surface of the transparent substrate.

In some exemplary embodiments, as shown in FIGS. 4A and 4B, the first groove of the transparent substrate 20 is filled with a metal layer. As shown in FIG. 4A, a cross section of the fourth metal line 221 formed by filling the first groove of the transparent substrate 20 has a shape of an epaulet (or an armband). As shown in FIG. 4B, a cross section of the third metal line 211 formed by filling the first groove of the transparent substrate 20 has a shape of an epaulet (or an armband). Cross sections of the fourth metal line 221 and the third metal line 211 have shapes similar to epaulets or armbands. Taking the fourth metal line 221 as an example, the cross section of the fourth metal line 221 may have a shape of combination of two wedge-like shapes, a bottom of the cross section of the fourth metal line 221 has a wedge-like shape formed by an intersection of two gradually converging curves, and a top of the cross section of the fourth metal line 221 has a wedge-like shape formed by an intersection of two gradually converging curves toward the bottom. The curves forming the bottom and the curves forming the top are connected correspondingly, and the above four curves all protrude to an outside of the fourth metal line 221. In some examples, taking the fourth metal line 221 shown in FIG. 4A as an example, the fourth metal line 221 fills the first groove of the transparent substrate 20, and a pit is formed on the part of the fourth metal line 221 above the transparent substrate 20, and a maximum depth of the pit is h2, that is, the maximum depth of the pit is the same as that of the first groove. A distance between a bottom of the pit and a bottom of the first groove is h3. In this exemplary embodiment, under a condition that line widths of metal lines of each group and distances between adjacent metal lines remain unchanged, with an increase of the number of metal lines in each group, the impedance loss may be reduced, but an area of the second hollow region may be reduced. Disposing a cross section of the metal line in an epaulet shape may increase an optical projection of the antenna, thereby ensuring the light transmittance of the antenna. In this way, increasing light transmittance and reducing impedance loss may both be considered.

In some exemplary embodiments, as shown in FIG. 3, a hollow pattern may be disposed at an intersection region of the third metal line group 21 and the fourth metal line group 22. The hollow pattern may include a plurality of rectangular openings, and a size of each rectangular opening is g1*g2. However, this is not limited in the present embodiment. For example, the hollow pattern may not be provided in the intersection region of the third metal line group 21 and the fourth metal line group 22. For another example, the rectangular openings of the hollow pattern in the intersection regions may have other sizes. In some examples, cross sections of the metal lines in the intersection region may be rectangular or non-rectangular. For example, when a hollow pattern is provided in the intersection region, in the intersection region, cross sections of a part of segments in a same direction as the third metal line 211 may be the same as that of the third metal line 211, and cross sections of a part of segments in a same direction as the fourth metal line 221 may be the same as that of the fourth metal line 221. However, arrangements of the metal lines in the intersection region are not limited in the present embodiment.

Figure 5:
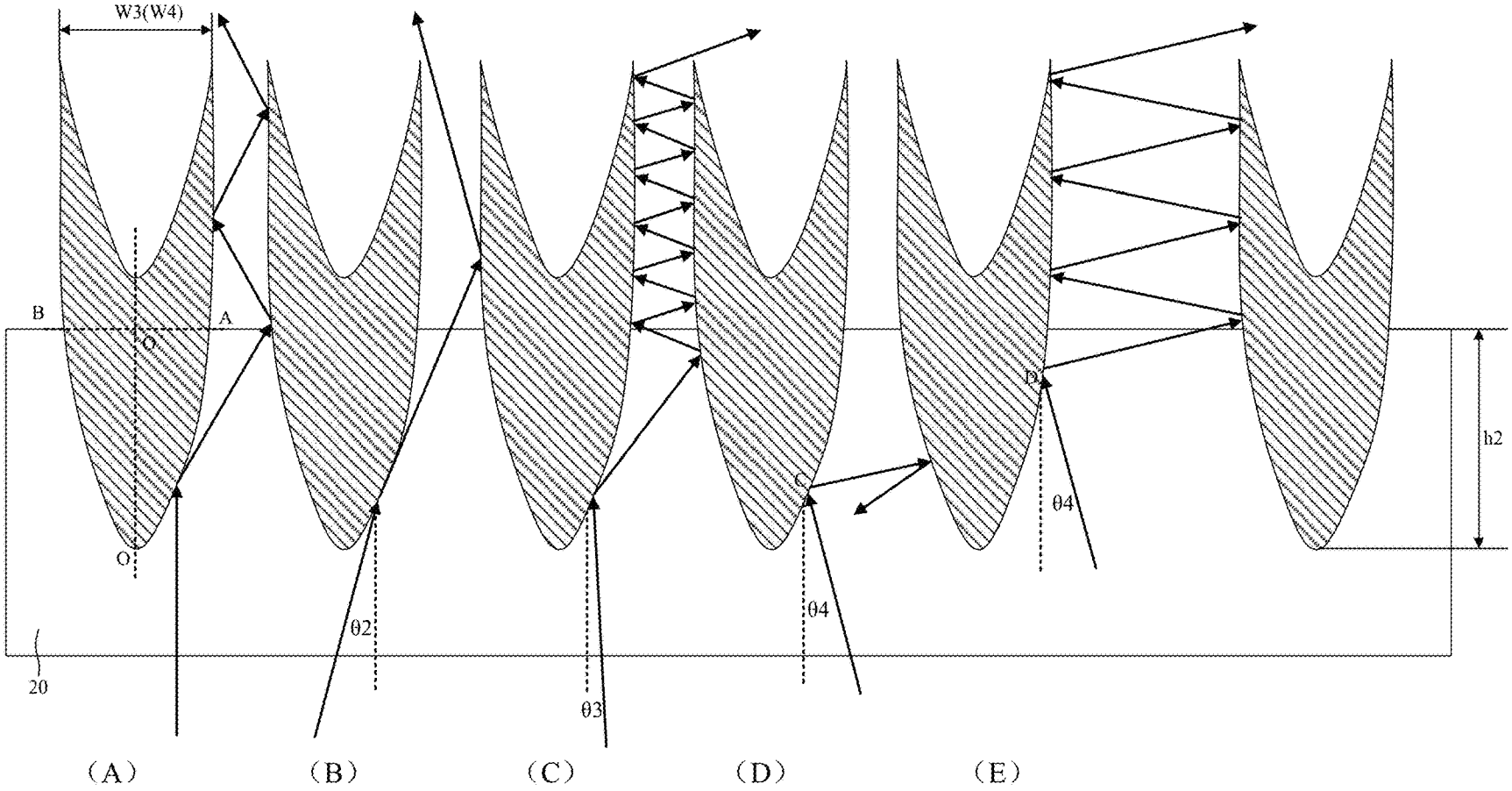
FIG. 5 is a schematic diagram of light incidence of an antenna according to at least one embodiment of the present disclosure.

FIG. 5 is a schematic diagram of light incidence of an antenna according to at least one embodiment of the present disclosure. In FIG. 5, five light incidence situations are illustrated. In FIG. 5, OO' represents an right forward normal of light incidence, that is, along a direction perpendicular to a transparent substrate plane, AB is a transparent substrate plane, and a solid arrow represents a light propagation path. In FIG. 5, an incident light on an OA surface is taken as an example, and an incident light on an OB surface from a side of the transparent substrate is similar, so the illustration is omitted here.

As shown in FIG. 5(A), an incident light is incident along a direction parallel to the right forward normal OO' (i.e., normal incidence of light enters the antenna), the incident light enters the transparent substrate 20 and scatters forward at a bottom of the metal lines, and then passes through the metal layer after a plurality of reflections between adjacent metal lines.

As shown in FIG. 5(B), a clockwise angle between an incident light and the right forward normal OO' is (360-θ2). For example, the incident light is located on a left side of the right forward normal OO', and the incident light enters the transparent substrate 20 and scatters forward at the bottom of the metal lines, and then passes through the metal layer after a plurality of reflections between adjacent metal lines.

As shown in FIG. 5(C), a clockwise angle between an incident light and the right forward normal OO' is θ3. For example, the incident light is located on a right side of the right forward normal OO', and the incident light enters the transparent substrate 20 and scatters forward at the bottom of the metal lines, and then passes through the metal layer after a plurality of reflections between adjacent metal lines. In FIG. 5(C), an angle of forward reflection of incident light becomes smaller. The reflection times of incident light between adjacent metal lines in FIG. 5(C) are greater than the reflection times of incident light between adjacent metal lines in FIGS. 5(A) and 5(B). Compared with the situations shown in FIG. 5(C), in FIG. 5(A) and FIG. 5(B), an incident light is easier to pass through the metal layer.

As shown in FIG. 5(D), a clockwise angle between an incident light and the right forward normal OO' is θ4, for example, the incident light is located on a right side of the right forward normal OO', and θ4 is greater than θ3, and an incident point C of the incident light is close to the bottom of the metal line. After entering the transparent substrate 20 and reaching the bottom of the metal line, the incident light is easily reflected backward and may not continue to spread forward, so that it may not effectively pass through the metal layer.

As shown in FIG. 5(E), a clockwise angle between an incident light and the right forward normal OO' is θ4. For example, the incident light is located on a right side of the right forward normal OO', and θ4 is greater than θ3, and an incident point D of the incident light is far away from the bottom of the metal line, and a distance between adjacent metal lines is larger. After entering the transparent substrate 20 and reaching the metal line, the incident light still has a chance to emit forward, and may pass through the metal layer through a plurality of reflections between adjacent metal lines.

It may be seen from FIG. 5 that a cross section of a bottom of the metal line is in a wedge-like shape, and the wedge-like bottom may reduce the blocking of the incident light. By scattering the incident light forward, the incident light may continue to spread forward after pass through the metal layer, thus increasing the light transmittance of the antenna.

In this exemplary embodiment, in order to keep a large forward scattering angle when the incident light is located on the right side of the right forward normal (for example, as shown in FIG. 5(C), FIG. 5(D) and FIG. 5(E)), a ratio between a maximum depth h2 of the first groove of the transparent substrate 20 and a line width of a metal line (for example, a third line width W3 or a fourth line width W4) may be increased to make an OA segment (or OB segment) steeper, which is beneficial to increase an incidence angle range of forward scattering of the incident light. In some examples, in a case of normal incidence (as shown in FIG. 5(A)), the ratio between the maximum depth h2 of the first groove of the transparent substrate 20 and the line width of the metal line (e.g., the third line width W3 or the fourth line width W4) is at least greater than 0.5, that is, an included angle between the OA segment (or OB segment) and the right forward normal OO' is less than 45 degrees, which may make the incident light from the transparent substrate scatter through the metal layer when passing the metal layer. In some examples, the ratio between the maximum depth h2 of the first groove of the transparent substrate 20 and the line width of the metal line may be increased by increasing the maximum depth h2 of the first groove or decreasing the line width of the metal line (e.g., the third line width W3 or the fourth line width W4).

In some exemplary embodiments, a line width of a metal line may range from 1 micron to 10 microns, for example, 3 microns; a maximum vertical distance between a surface of the first groove and a surface of the transparent substrate may range from 2 microns to 25 microns, for example, 6 microns. The line width of the metal line in this example is smaller than a limit size of distinct vision, which makes it indistinguishable in human vision and may achieve an unobstructed effect; furthermore, the line width of the metal line in this example is at least three times greater than a skin depth of the metal material (e.g., silver) in a microwave band or a millimeter wave band, which may reduce the impedance; in addition, a ratio of a maximum depth of the first groove to the line width of the metal line in this example is beneficial to increase an incident angle range of incident light scattering forward.

Figure 6:
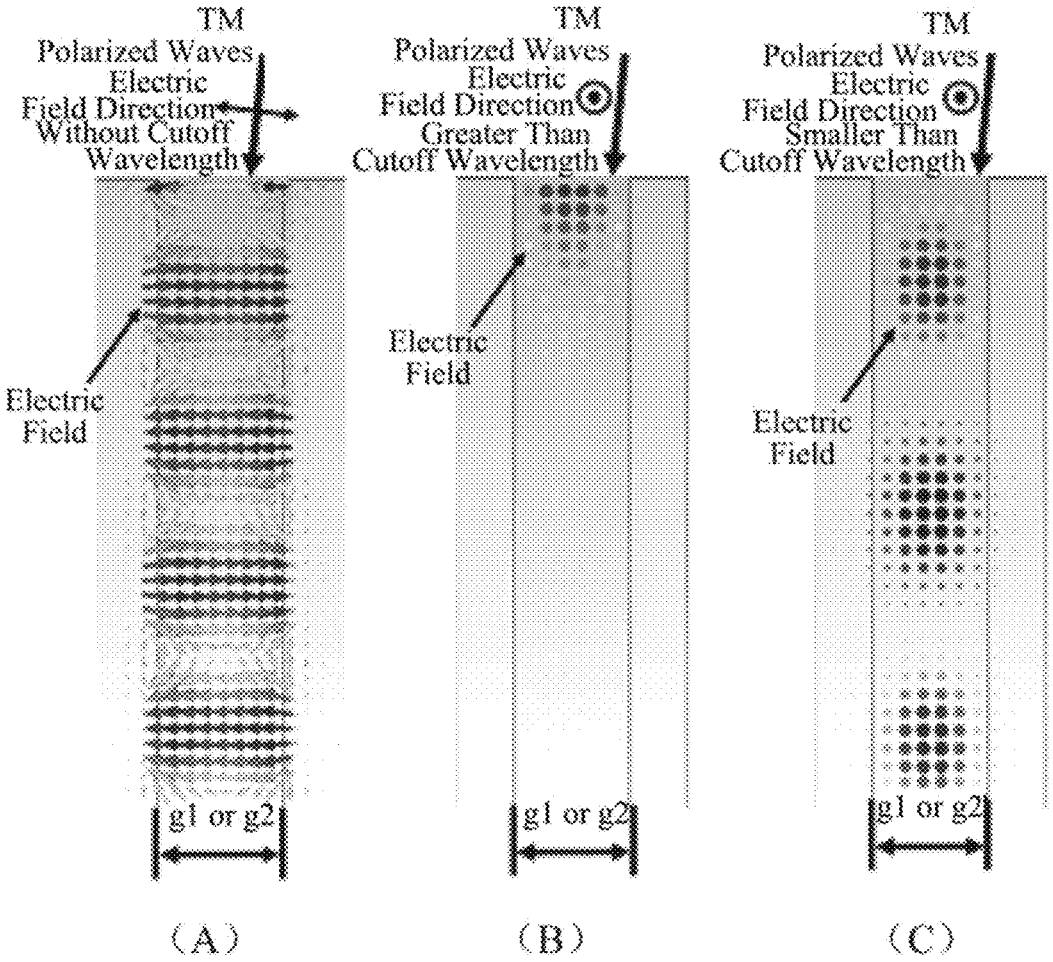
FIG. 6 is a schematic diagram of different incident polarized waves passing through gaps between adjacent metal lines.

In some examples, spacing (e.g., a first spacing g1 or a second spacing g2) between adjacent metal lines in one metal line group (e.g., a third metal line group or a fourth metal line group) may be greater than or equal to 0.2 microns. For example, when a distance between adjacent metal lines in a metal line group is greater than 0.4 microns, as shown in FIG. 5(E), it may be beneficial to increase the incident angle range of incident light scattering forward. When a distance between adjacent metal lines in a metal line group is smaller than about 0.4 microns, it is needed to consider transmittance of different incident polarized waves respectively, that is, transverse magnetic (TM) waves with magnetic field perpendicular to an incident plane and transverse electric (TE) waves with electric field perpendicular to the incident plane. FIG. 6 is a schematic diagram of different incident polarized waves passing through gaps between adjacent metal lines. As shown in FIG. 6(A), for TM polarized waves, a "gap surface plasma wave" may be formed, and light of any wavelength may still pass through a narrow aperture between adjacent metal lines and go forward. For TE polarized waves, a cutoff wavelength of transmission may appear. As shown in FIG. 6(B), when an incident wavelength is greater than a cutoff wavelength, an incident light will quickly decay in a gap between adjacent metal lines and may not pass through the metal layer. As shown in FIG. 6(C), when an incident wavelength is smaller than a cutoff wavelength, an incident light may pass through the metal layer. Considering TM polarized waves and TE polarized waves comprehensively, when an environmental refractive index is about 1.5, a distance between adjacent metal lines in a group of metal lines (for example, a first distance g1 or a second distance g2) is at least greater than 0.2 microns, so that TE polarized waves in all visible light bands may be ensured to pass through. In order to enable near infrared light to pass through a gap between adjacent metal lines, a distance between the adjacent metal lines should be at least greater than 0.5 microns.

The structure of the antenna is described below through an example of a preparation process of the antenna. The "patterning process" mentioned in the embodiment of the present disclosure includes processes of film layer deposition, photoresist coating, mask exposure, development, etching, and photoresist stripping, etc. Deposition may be implemented by any one or more of sputtering, evaporation, and chemical vapor deposition, coating may be implemented by any one or more of spraying and spin coating, and etching may be implemented by any one or more of dry etching and wet etching. A "thin film" refers to a layer of thin film manufactured by deposition or coating of a certain material on a substrate base. If the "thin film" does not need a patterning process during the whole manufacturing process, the "thin film" may also be called a "layer". If the "thin film" needs a patterning process throughout the whole manufacturing process, it is referred to as a "thin film" before the patterning process and as a "layer" after the patterning process. The "layer" subsequent to the patterning process contains at least one "pattern".

In some exemplary embodiments, the preparation process of the antenna may include the following steps.

(1) A Transparent Substrate is Provided.

Figure 7:
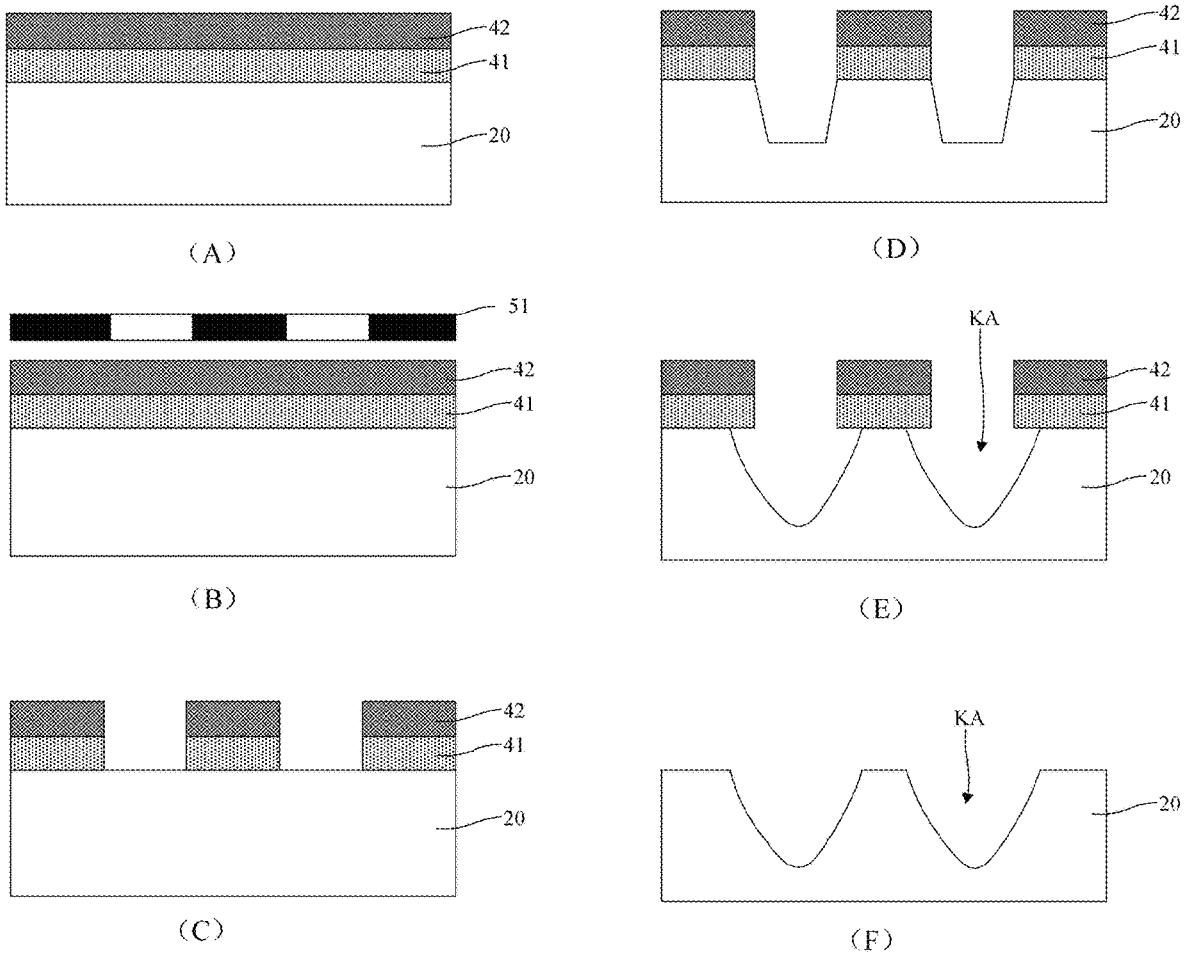
FIG. 7 is a schematic diagram for preparing a transparent substrate of an antenna according to at least one embodiment of the present disclosure.

In some exemplary embodiments, with reference to FIG. 7, the transparent substrate being a glass substrate is taken as an example for explanation. As shown in FIG. 7(A), a metal thin film 41 is deposited on the glass substrate 20, and a photoresist 42 is coated. The metal film 41 may be made of a metal material such as nickel (Ni) or chromium (Cr). Then, the glass substrate 20 coated with the photoresist 42 is exposed through a mask 51, as shown in FIG. 7(B). Then, the photoresist 42 is developed, and the metal film 41 in an exposed region is etched to expose a surface of the glass substrate 20 in the exposed region, as shown in FIG. 7(C). Then, the exposed glass substrate 20 is subjected to RIE (Reactive Ion Etching) to form an etching pit on the glass substrate 20, as shown in FIG. 7(D). Wherein, a depth-width ratio of the etching pit may range from 20:1 to 30:1. Then, a solution of hydrogen fluoride (HF) and ammonium fluoride (NH4F) is used to continue etching the etching pit formed on the glass substrate 20 to form a first groove KA with a wedge-like cross section, as shown in FIG. 7(E). Then, the photoresist 42 and the metal film 41 are removed to obtain the glass substrate 20 having the first groove KA with the wedge-like cross section, as shown in FIG. 7(F).

In this exemplary embodiment, the glass substrate is etched in a mixed way of dry etching and wet etching, so that a surface morphology and an etching depth of glass etching may be well controlled. Since the wet etching with HF and NH4F solution is an isotropic etching, a transverse etching rate of this method is faster than a longitudinal etching rate, and direct use of this method is not conducive to larger h2/W4 or h2/W5. Therefore, in this example, the etching pit with larger depth-width ratio may be obtained by dry etching with RIE, and then the etching depth may be deepened and the etched surface morphology may be corrected by wet etching with hydrogen fluoride (HF) and ammonium fluoride (NH4F) solution. However, this embodiment is not limited to a formation mode of the first groove on the glass substrate. For example, the first groove may alternatively be formed on the glass substrate by mechanical etching, laser ablation, etc.

(2) A Metal Layer is Formed on the Transparent Substrate.

In some exemplary embodiments, a metal thin film is deposited on the transparent substrate 20 where the aforementioned structure is formed, and the metal thin film is patterned by a patterning process to form a metal layer with a second hollow region, as shown in FIGS. 4A and 4B. The second hollow region is surrounded by a plurality of groups of metal lines, and cross sections of the metal lines have a shape of epaulet. In the preparation process of the metal layer, a deposition thickness of the metal thin film is h3, and the deposition thickness h3 of the metal thin film may be greater than a maximum depth h2 of the first groove.

In some exemplary embodiments, a metal layer may be made of metal material, such as any one or more of silver (Ag), copper (Cu), aluminum (Al), titanium (Ti) and molybdenum (Mo), or alloy of the above metals, such as aluminum neodymium alloy (AlNd) or molybdenum niobium alloy (MoNb), and may have a single-layered structure or a multi-layered composite structure, such as Ti/Al/Ti.

(3) The Metal Layer is Covered with an Organic Layer.

In some exemplary embodiments, an organic material is coated on the glass substrate 20 where the aforementioned structure is formed to form an organic layer 30 covering the entire glass substrate 20, as shown in FIGS. 4A and 4B. The organic layer 30 has effects of planarization and protection for the metal layer.

The description of the structure and preparation process of the antenna according to embodiments of the present disclosure is merely illustrative. In some exemplary embodiment, according to actual needs, corresponding structures may be changed and processes may be added or reduced. For example, it is not needed to form the first groove on the glass substrate of the antenna, an organic layer with the first groove may be formed on the glass substrate, and then a metal line with a non-rectangular cross section may be formed in the organic layer. For another example, a metal line with a non-rectangular cross section may be directly formed on a flat glass substrate. However, it is not limited here in the present disclosure.

In this exemplary embodiment, light transmittance of the antenna may be improved and impedance loss in a microwave band or a millimeter wave band may be reduced by forming a first groove with a wedge-like cross section on the glass substrate, and then forming a metal line with an epaulet-shaped cross section on the first groove, and forming a second hollow region by enclosures of a metal line group.

The preparation process of the antenna of this exemplary embodiment may be achieved by using the existing mature preparation equipment, which may be well compatible with the existing preparation process, and has advantages of simple process realization, easy implementation, high production efficiency, low production cost and high yield rate.

Figure 8:
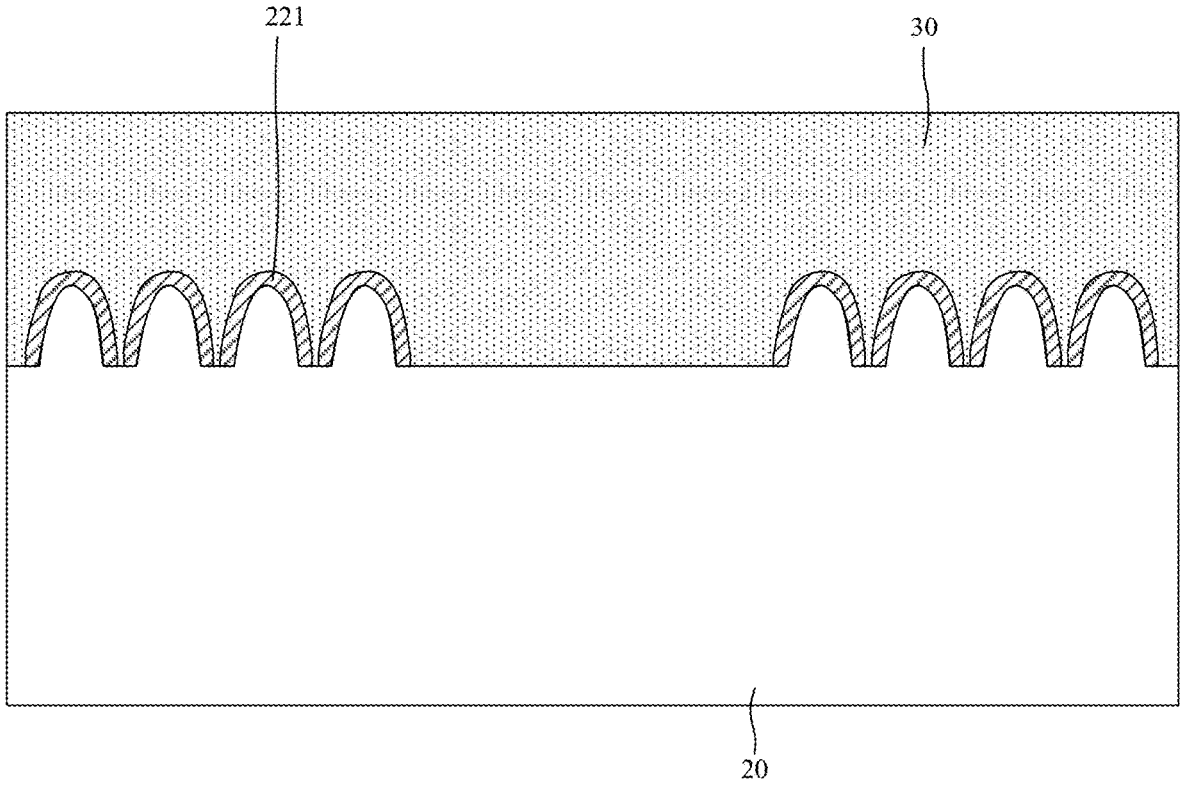
FIG. 8 is another schematic sectional view along P-P direction in FIG. 3.

FIG. 8 is another schematic sectional view along the P-P direction in FIG. 3. In some exemplary embodiments, as shown in FIG. 8, on a direction perpendicular to the transparent substrate 20, the antenna includes a transparent substrate 20, a metal layer having a plurality of second hollow regions, and an organic layer 30 covering the metal layer. The transparent substrate 20 has a plurality of first protrusions on a surface close to the metal layer. A width of a cross section of the first protrusion gradually decreases along a direction away from a surface of the transparent substrate. The metal line 221 of the metal layer covers the first protrusion. Taking a fourth metal line 221 shown in FIG. 8 as an example, the fourth metal line 221 covers a surface of the first protrusion, and a projection of the fourth metal line 221 on the transparent substrate 20 covers a projection of the first protrusion on the transparent substrate. The cross section of the first protrusion is, for example, wedge-like, and the cross section of the fourth metal line 221 is, for example, inverted U-shaped. For example, a top of the cross section of the first protrusion has a shape formed by an intersection of two gradually converging curves. In some examples, the cross section of the first protrusion has a shape of, for example, an inverted triangle, and the cross section of the fourth metal line has, for example, an inverted V-shape. In this exemplary embodiment, light may be incident from a side of the organic layer 30, and may be emitted from the transparent substrate 20 through the metal layer by an optical projection in the metal layer. This exemplary embodiment may ensure light transmittance of the antenna by increasing the optical projection of the antenna.

Other structures of the present embodiment may be referred to the descriptions of the above embodiments and will not be further illustrated here.

Figure 9:
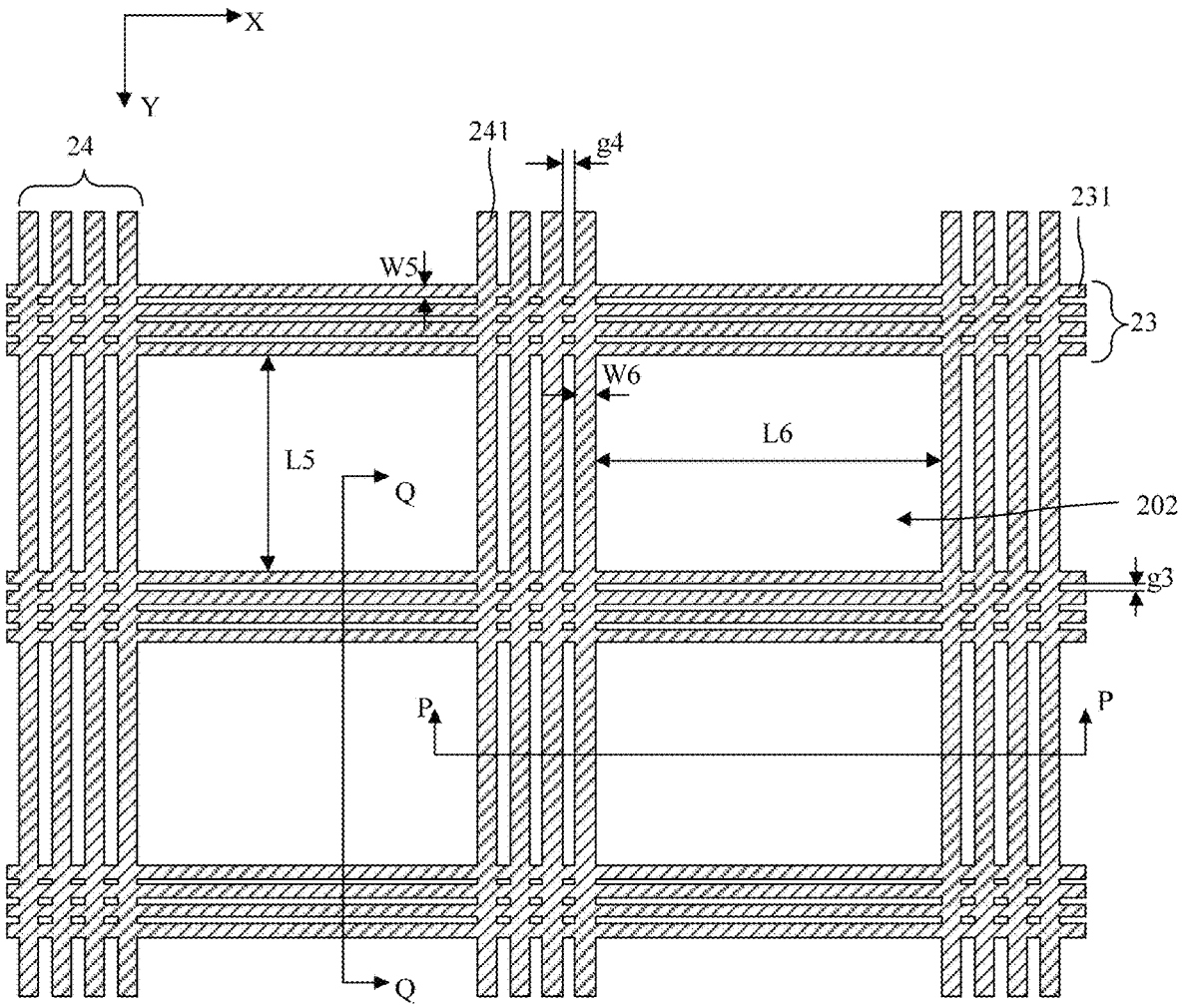
FIG. 9 is another top view of an antenna according to at least one embodiment of the disclosure.
Figure 10A:
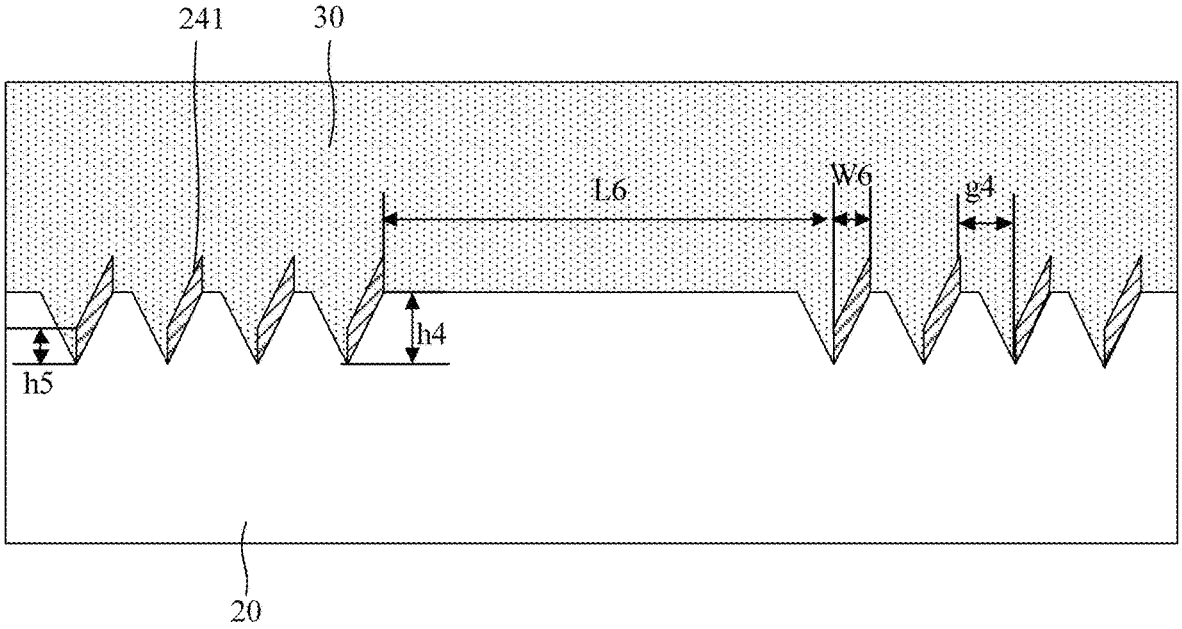
FIG. 10A is a schematic sectional view along P-P direction in FIG. 9.
Figure 10B:
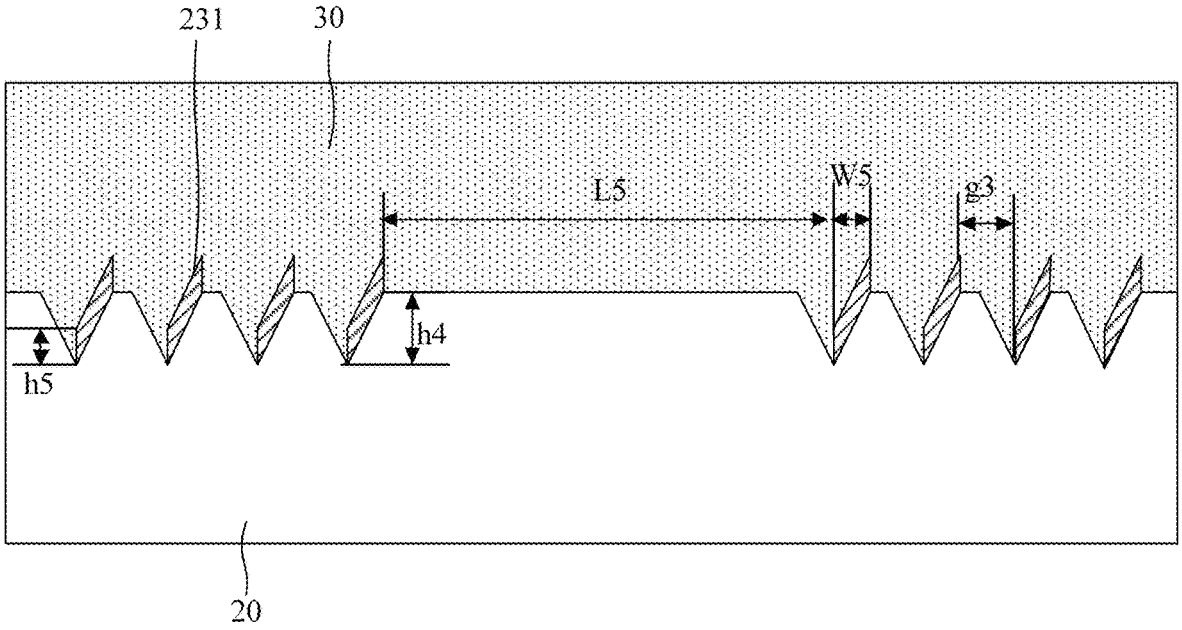
FIG. 10B is a schematic sectional view along Q-Q direction in FIG. 9.

FIG. 9 is another top view of an antenna according to at least one embodiment of the disclosure. FIG. 10A is a schematic sectional view along P-P direction in FIG. 9; FIG. 10B is a schematic sectional view along Q-Q direction in FIG. 9. The antenna shown in FIG. 9 may be applied to a display system or an imaging system. The antenna of this example may be a transparent antenna in a microwave band or a millimeter band. The antenna of this exemplary embodiment may increase light energy passing through the antenna, reduce impedance loss in the microwave band or the millimeter wave band, and keep forming clear image points.

In some exemplary embodiments, as shown in FIG. 9, a metal layer of the antenna may include a plurality of third hollow regions 202 on a direction parallel to the transparent substrate. In this example, the third hollow region 202 is illustrated as a rectangle. However, a shape of the third hollow region is not limited in this embodiment. In some examples, the third hollow region may be triangular, rhombic, polygonal, or irregular in shape (e.g., a shape with curved edges).

In some exemplary embodiments, as shown in FIG. 9, the rectangular third hollow region 202 has a sixth side length L6 along a first direction (X direction as shown in FIG. 9) and a fifth side length L5 along a second direction (Y direction as shown in FIG. 9). The rectangular third hollow region 202 is surrounded and formed by two groups of fifth metal line groups 23 and two groups of sixth metal line groups 24. In other words, the third hollow region 202 is surrounded and formed by four metal line groups. The fifth metal line group 23 includes four fifth metal lines 231 parallel to each other and extending along the X direction, and the sixth metal line group 24 includes four sixth metal lines 241 parallel to each other and extending along the Y direction. As shown in FIG. 9, the fifth metal line 231 has a fifth line width W5, and the sixth metal line 241 has a sixth line width W6. The fifth line width W5 of the fifth metal line 231 and the sixth line width W6 of the sixth metal line 241 may be the same or different. There is a third spacing g3 between two adjacent fifth metal lines 231 in the fifth metal line group 23 and a fourth spacing g4 between two adjacent sixth metal lines 241 in the sixth metal line group 24. The third spacing g3 and the fourth spacing g4 may be the same or different. In this embodiment, the number of metal lines in each metal line group, a line width of each metal line and spacing between adjacent metal lines are not limited. In this exemplary embodiment, in order to increase the light transmittance of the transparent antenna, a ratio of a side length of the third hollow region to a width of the metal line may be increased to expand an area of the hollow region.

In some exemplary embodiments, as shown in FIGS. 10A and 10B, on a direction perpendicular to the transparent substrate, the antenna includes a transparent substrate 20, a metal layer with a plurality of third hollow regions, and an organic layer 30 covering the metal layer. The transparent substrate 20 may be a hard substrate (e.g., a glass substrate) or a flexible substrate (e.g., a substrate formed of organic materials such as polyimide). The organic layer 30 may be made of transparent organic materials, such as PET material, PVB material, COP material, acrylate resin, or transparent scratch-resistant or corrosion-resistant coating with light transmittance above 90%. The organic layer 30 not only has a planarization effect, but also has an effect of matching refractive index of the transparent substrate 20. However, this is not limited in the present embodiment.

In some exemplary embodiments, as shown in FIGS. 10A and 10B, the transparent substrate 20 has a plurality of second grooves on a surface close to the metal layer on a direction perpendicular to the transparent substrate. A width of a cross section of the second groove gradually decreases along a direction away from the metal layer. As shown in FIGS. 10A and 10B, the cross section of the second groove is V-shaped. However, this is not limited in the present embodiment. In some examples, a cross section of the second groove may have other shapes whose width gradually decreases in a direction away from the metal layer, such as inverted trapezoid, wedge-like shape, etc. As shown in FIGS. 10A and 10B, a maximum vertical distance h4 (i.e., a maximum depth of the second groove) between a surface of the second groove on the transparent substrate 20 and a surface of the transparent substrate 20 is greater than a deposition thickness h5 of the metal layer.

In some exemplary embodiments, as shown in FIGS. 10A and 10B, inclined directions of adjacent metal lines in one metal line group of the metal layer are parallel to each other, and a projection of at least one metal line in one metal line group on the transparent substrate is at least partially overlapped with a projection of the second groove on the transparent substrate. Taking a V-shaped cross section of the second groove as an example, the second groove has a first slope and a second slope opposite to each other, and the metal layer only covers the first slope or the second slope of the second groove, so that the inclined directions of the adjacent metal lines are parallel to each other. However, this is not limited in the present embodiment. For example, metal lines may be formed on the first slope and part of the second slope of the second groove, or only on part of the first slope of the second groove.

In some exemplary embodiments, as shown in FIG. 10B, a cross section of the fifth metal line 231 of the metal layer is a standing parallelogram. As shown in FIG. 10A, a cross section of the sixth metal line 241 of the metal layer is a standing parallelogram. Taking the sixth metal line 241 shown in FIG. 10A as an example, the sixth metal line 241 is formed on a right slope of the second groove. A bottom of the sixth metal line 241 is located at a bottom of the second groove, and a distance between a top of the second groove and an upper surface of the glass substrate is the metal deposition thickness h5.

In some exemplary embodiments, as shown in FIG. 9, a hollow pattern may be provided at an intersection region of the fifth metal line group 23 and the sixth metal line group 24. The hollow pattern may include a plurality of rectangular openings, and a size of each rectangular opening is g3*g4.

However, this is not limited in the present embodiment. For example, the hollow pattern may not be provided in the intersection region of the fifth metal line group 23 and the sixth metal line group 24. For another example, the rectangular openings of the hollow pattern in the intersection regions may have other sizes. In some examples, cross sections of the metal lines in the intersection region may be rectangular or non-rectangular. For example, when a hollow pattern is provided in the intersection region, in the intersection region, cross sections of a part of segments in a same direction as the fifth metal line 231 may be the same as that of the fifth metal line 231, cross sections of a part of segments in a same direction as the sixth metal line 241 may be the same as that of the sixth metal line 241. However, arrangements of the metal lines in the intersection region are not limited in the present embodiment.

Figure 11:
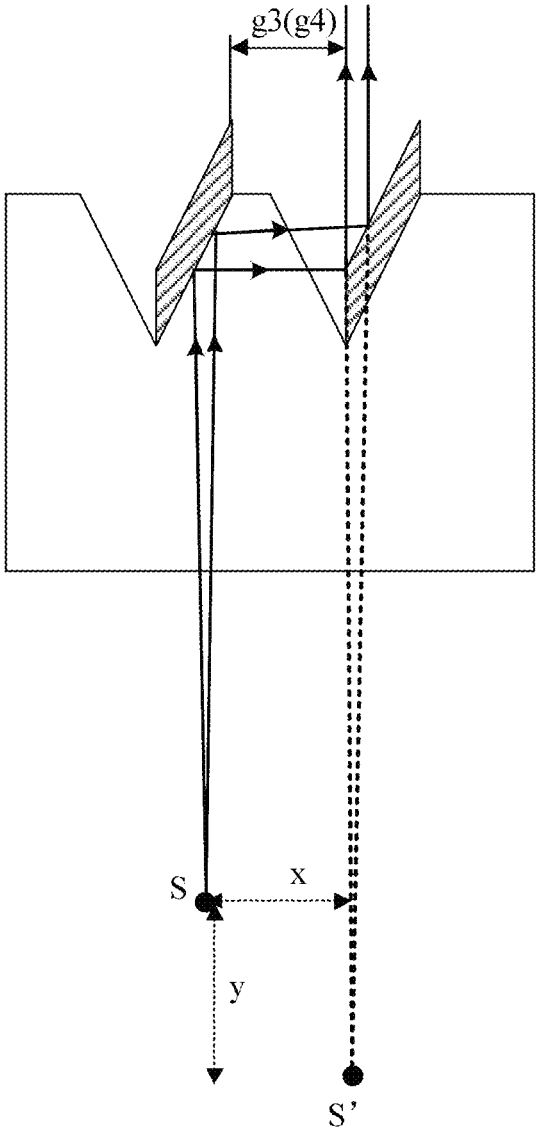
FIG. 11 is a schematic diagram of imaging of at least one embodiment of the present disclosure.

FIG. 11 is a schematic diagram of imaging of an antenna according to at least one embodiment of the present disclosure; As shown in FIG. 11, when light emitted by a certain pixel light emitting point S on a display screen is incident on the antenna of this exemplary embodiment, the light may directly pass through the third hollow region without affecting the display, while the light emitted by the pixel light emitting point S may be reflected twice through a metal line with a standing parallelogram cross section in the region where the metal line is located, so as to keep the light going forward and form an image point S'. The formed image point S' has a displacement (represented by x) in a plane of the display screen relative to the original pixel light emitting point S, and may also have a displacement (represented by y) in a direction perpendicular to the display screen. In this example, adjacent metal lines are used as reflection planes to reflect light. When reflection plane spacing between adjacent metal lines is small, for example, on the order of magnitude of several microns to more than ten microns, or even smaller than a size of one pixel, the displacement x is within one pixel, which will not cause any image crosstalk influence on the whole two-dimensional display plane, and the displacement y is also on the order of magnitude of microns to more than ten microns, which basically does not affect pattern resolution. When the reflection plane spacing between the adjacent metal lines is larger than one pixel size and smaller than a limit size of distinct vision of human eyes, it still does not affect a display effect of the whole image. In this example, the third spacing g3 and the fourth spacing g4 are at least greater than 1 micron, which may reduce optical diffraction and interference effects. Furthermore, a total width between the fifth side length L5 or the sixth side length L6 of the third hollow region and a metal line group (for example, the fifth metal line group or the sixth metal line group) is greater than or equal to 10:1, so as to achieve the best light transmission effect. For example, when a line width of a single metal line in each group of metal lines is 2 to 3 microns, the number of metal lines in each group of metal lines may be less than or equal to 10, thereby reducing interference effects.

In some exemplary embodiments, the preparation process of the antenna of this embodiment may include the following steps.

(4) A Transparent Substrate is Provided.

In some exemplary embodiments, a plurality of second grooves having V-shaped cross sections may be formed on the transparent substrate 20. The preparation process of the transparent substrate may refer to the above step (1), so it will not be described in detail here.

(5) A Metal Layer is Formed on the Transparent Substrate.

Figure 12:
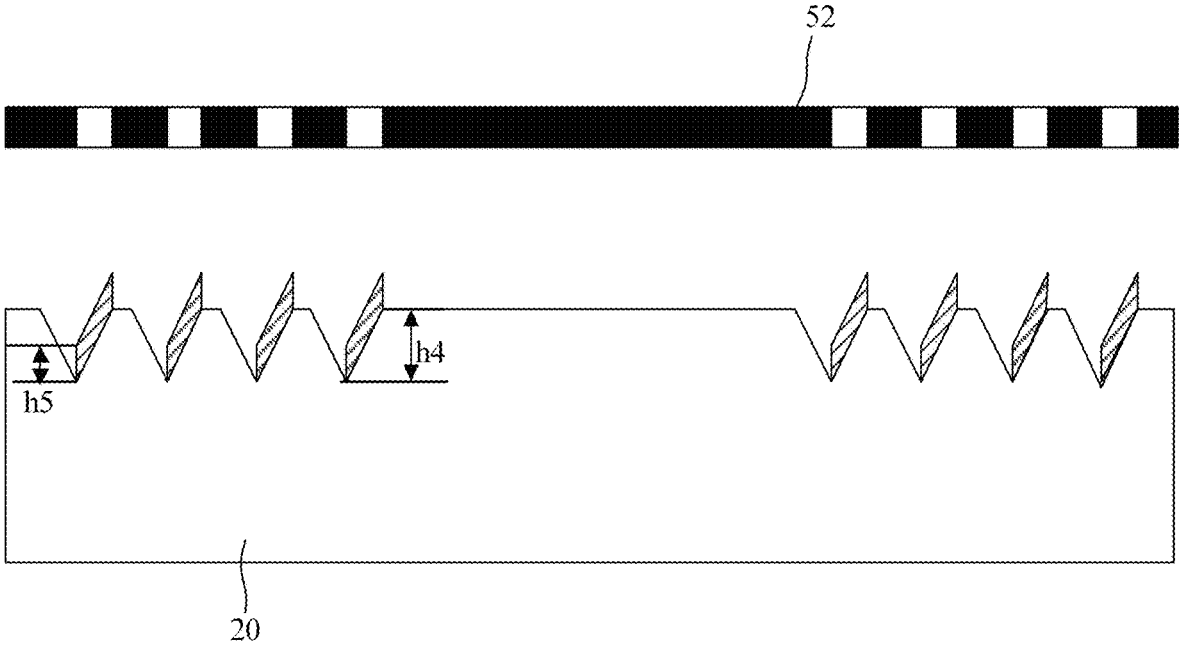
FIG. 12 is a schematic diagram for preparing a metal layer of an antenna according to at least one embodiment of the present disclosure.

In some exemplary embodiments, a metal thin film is deposited on the transparent substrate where the aforementioned structure is formed, wherein a mask 52 is used to control the deposition region of the metal thin film to form a metal layer with a third hollow region, as shown in FIG. 12. Wherein, the third hollow region is surrounded by a plurality of groups of metal lines, each group of metal lines includes at least two metal lines, and a cross section of the metal line has a shape of a standing parallelogram. However, this is not limited in the present embodiment. In some examples, a series of processes such as spin coating photoresist, exposure, development, metal deposition and stripping may be used to control the deposition region of the metal thin film.

(6) The Metal Layer is Covered with an Organic Layer.

In some exemplary embodiments, an organic material is coated on the glass substrate 20 where the aforementioned structure is formed to form an organic layer 30 covering the entire glass substrate 20, as shown in FIGS. 10A and 10B. The organic layer 30 may be made of low-loss organic materials in a microwave band or a millimeter wave band. The organic layer 30 has a planarization function and may also match the refractive index of the glass substrate.

The description of the structure and preparation process of the antenna according to embodiments of the present disclosure is merely illustrative. In some exemplary embodiment, according to actual needs, corresponding structures may be changed and processes may be added or reduced. For example, it is not needed to form the second groove on the glass substrate of the antenna, an organic layer with the second groove may be formed on the glass substrate, and then a metal line with a non-rectangular cross section may be formed in the organic layer. For another example, a metal line with a non-rectangular cross section is directly formed on a flat glass substrate. However, the present disclosure is not limited here.

Figure 13:
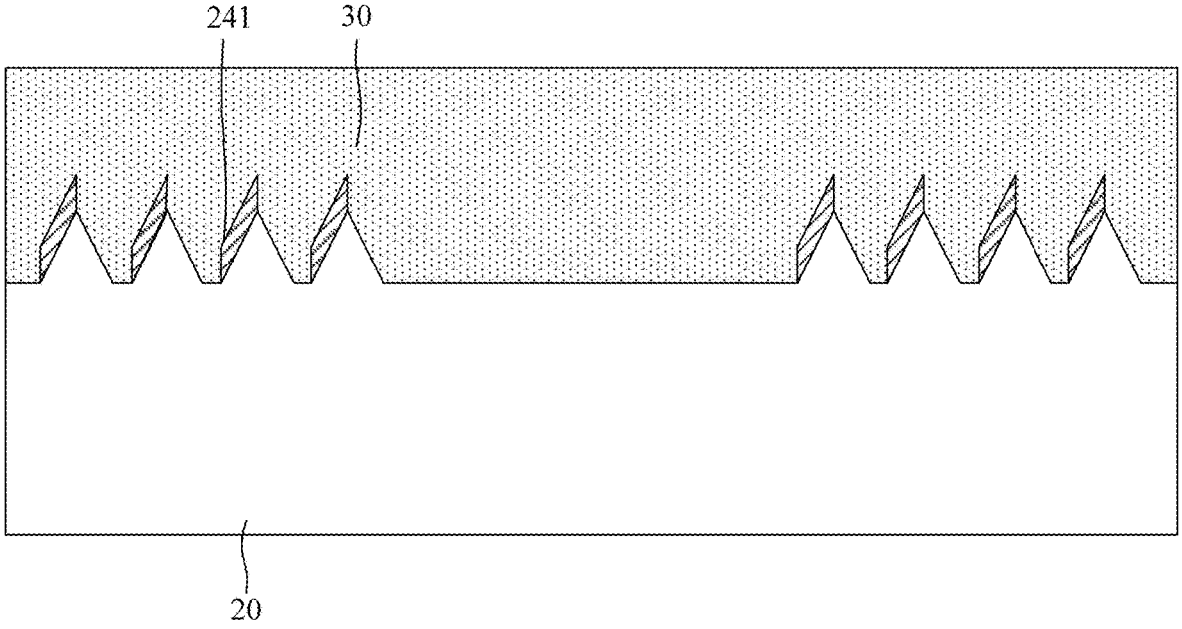
FIG. 13 is another schematic sectional view along P-P direction in FIG. 9.

FIG. 13 is another schematic sectional view along the P-P direction in FIG. 9. In some exemplary embodiments, as shown in FIG. 13, on a direction perpendicular to the transparent substrate 20, the antenna includes a transparent substrate 20, a metal layer having a plurality of second hollow regions, and an organic layer 30 covering the metal layer. The transparent substrate 20 has a plurality of second protrusions on a surface close to the metal layer. A width of a cross section of the second protrusion gradually decreases in a direction away from a surface of the transparent substrate. Taking the cross section of the second protrusion being an inverted V-shape as shown in FIG. 13, the second protrusion has a third slope and a fourth slope opposite to each other, and the metal layer only covers the third or fourth slopes of the second protrusion, so that inclined directions of adjacent metal lines are parallel to each other. A cross section of the fourth metal line 221 has a shape of, for example, a standing parallelogram. In this exemplary embodiment, light may be incident from a side of the transparent substrate 20, and may be emitted from the organic layer 30 after pass through the metal layer by an optical projection in the metal layer. In this exemplary embodiment, by increasing the optical projection of the antenna, the light transmittance of the antenna may be ensured, and the incident light may be reflected twice through the metal lines whose cross sections having a shape of standing parallelogram, so as to keep the light going forward, keep the formation of clear image points, and avoid affecting the display effect.

Figure 14:
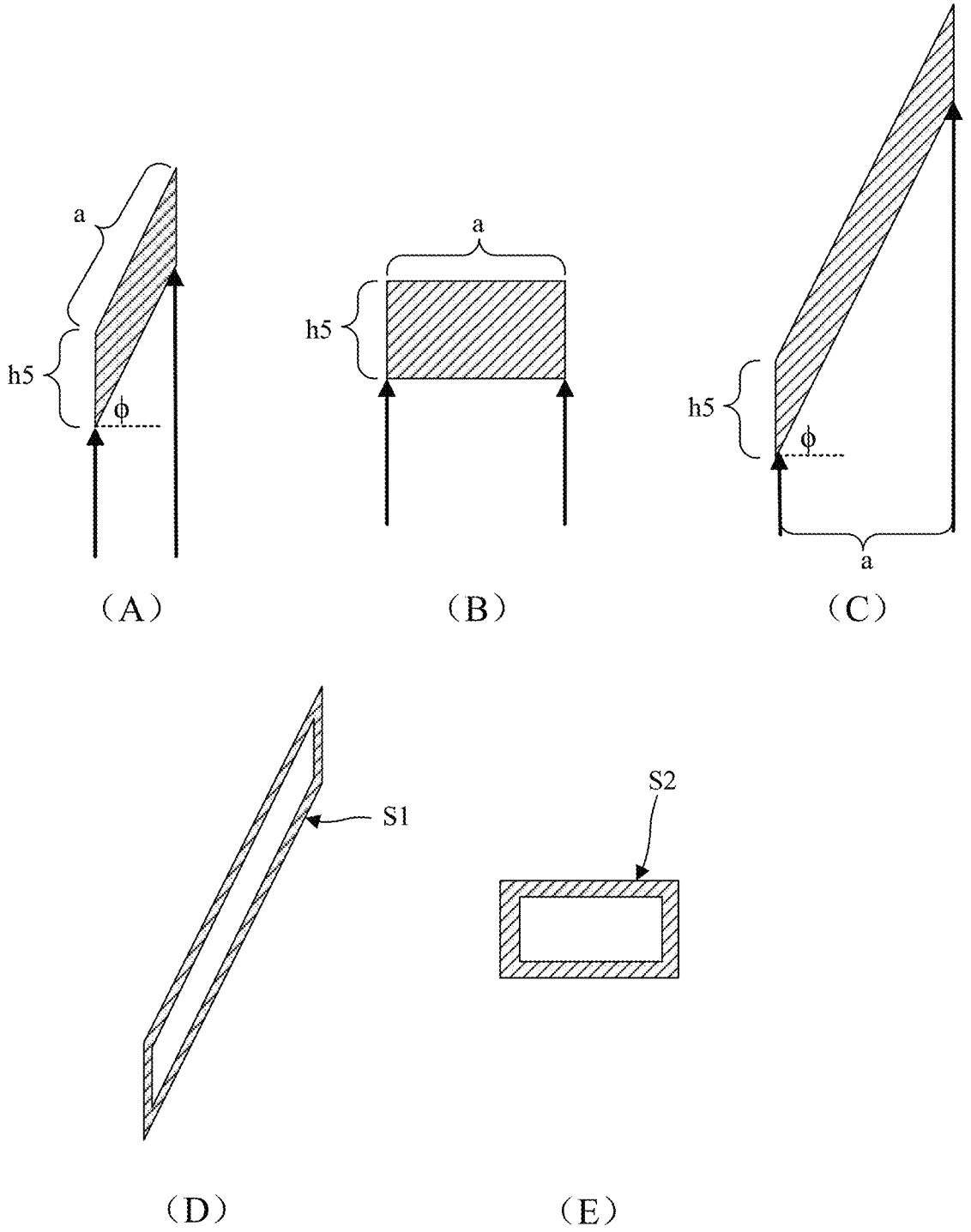
FIG. 14 is a comparative schematic diagram of a metal line with a parallelogram cross section and a metal line with a rectangular cross section according to at least one embodiment of the present disclosure.

FIG. 14 is a comparative schematic diagram of a metal line with a parallelogram cross section and a metal line with a rectangular cross section according to at least one embodiment of the present disclosure. As shown in FIG. 14(A), taking the cross section of the metal line having a shape of a standing parallelogram as an example, a length of a long side of the parallelogram is a, and an included angle between the long side of the parallelogram and an upper surface of the transparent substrate is $\phi$, and a part of the light that is blocked and may not be directly transmitted is only $a\times\cos\phi$. As shown in FIG. 14(B), a part of the light blocked by a metal line with a rectangular cross section is a, which is larger than a part of the light blocked by a metal line with a parallelogram cross section. As shown in FIG. 14(C), if a blocked part of the light blocked by a metal line with a parallelogram cross section is also a, a length of an oblique side of the parallelogram is $a/\cos\phi$. Assuming that a deposition thickness of the metal layer is h5 and a skin depth is $\Delta$, an area of a cross section S1 of a skin current of a metal line with a parallelogram cross section is approximately $a/\cos\phi\times\Delta+h5\times\cos\phi\times\Delta-\Delta2$ as shown in FIG. 14(D); while an area of a cross section S2 of a skin current of a metal line with a rectangular cross section is approximately $a\times\Delta+h5\Delta\Delta-\Delta2$, as shown in FIG. 14(E). When the deposition thickness h5 of the metal layer is smaller than $a/\cos\phi$, S1 will be smaller than S2, and impedance and loss in the metal line with a rectangular cross section will be greater than that in the metal line with a parallelogram cross section.

In this exemplary embodiment, light transmittance of the antenna may be improved and impedance loss in a microwave band or a millimeter wave band may be reduced by forming a second groove with a V-shaped cross section on the glass substrate, and then forming a metal line with a parallelogram cross section on the second groove, and forming a third hollow region by being surrounded by a metal line group.

The preparation process of the antenna of this exemplary embodiment may be achieved by using the existing mature preparation equipment, which may be well compatible with the existing preparation process, and has advantages of simple process realization, easy implementation, high production efficiency, low production cost and high yield rate.

At least one embodiment of the present disclosure further provides a method for preparing an antenna, which includes: providing a transparent substrate; forming a metal layer on the transparent substrate, wherein the metal layer includes a plurality of hollow regions, and at least one hollow region in the plurality of hollow regions is surrounded by at least one metal line group, wherein the at least one metal line group includes at least one metal line, and a cross section of the at least one metal line is non-rectangular.

In some exemplary embodiments, the transparent substrate is a glass substrate. Providing the transparent substrate includes etching a plurality of non-planar structures on the glass substrate in a mixed mode of dry etching and wet etching, wherein a cross section of at least one non-planar structure in the plurality of non-planar structures has a shape of gradually decreasing width along a direction away from a surface of the transparent substrate.

In some exemplary embodiments, forming the metal layer on the transparent substrate includes depositing a metal thin film on a part of region in at least one non-planar structure of the transparent substrate by using a mask to form a metal layer, wherein at least one metal line group of the metal layer includes at least two metal lines, and inclined directions of adjacent metal lines in the at least one metal line group are parallel to each other on a direction perpendicular to the transparent substrate.

A preparation method of the antenna of this embodiment may be referred to the descriptions of the aforementioned embodiments and will not be further illustrated here.

Figure 15:
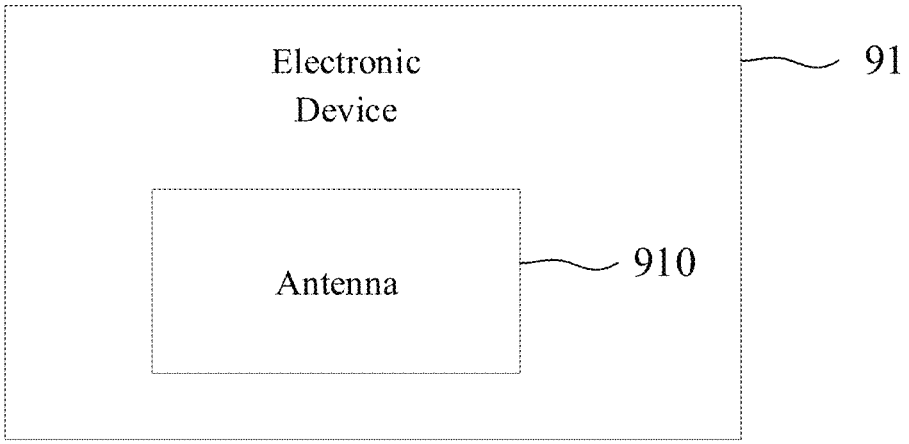
FIG. 15 is a schematic diagram of an electronic device according to at least one embodiment of the disclosure.

FIG. 15 is a schematic diagram of an electronic device according to at least one embodiment of the disclosure. As shown in FIG. 15, this embodiment provides an electronic device 91, which includes an antenna 910. The antenna 910 is the antenna provided in the previous embodiment. The electronic device 91 may be any product or component with communication function such as a smart phone, a navigation device, a game machine, a TV, a car audio, a tablet computer, a personal multimedia player (PMP), a personal digital assistant (PDA), etc. However, this is not limited in the present embodiment.

In some examples, the antenna 910 may be an antenna applicable for a non-display system or a non-imaging system provided in the embodiment shown in FIG. 3, and the electronic device 91 may be a product or a component without a display or imaging function, for example, a solar photovoltaic panel of a satellite. The antenna 910 may be an antenna applicable for a display system or an imaging system provided in the embodiment shown in FIG. 9, and the electronic device 91 may be a product or a component with a display or imaging function.

The drawings in the present disclosure only refer to the structures involved in the present disclosure, and common designs may be referred to for other structures. The embodiments of the present disclosure and the features in the embodiments may be combined with each other to obtain a new embodiment if there is no conflict.

Those of ordinary skills in the art should understand that modifications or equivalent substitutions may be made to the technical solutions of the present disclosure without departing from the spirit and scope of the technical solutions of the present disclosure, all of which should be included within the scope of the claims of the present disclosure.

What is claimed is:

1. An antenna, comprising:

a transparent substrate and a metal layer disposed on the transparent substrate;

the metal layer comprises a plurality of hollow regions, at least one hollow region in the plurality of hollow regions is surrounded by at least one metal line group, and the at least one metal line group comprises at least one metal line; a cross section of the at least one metal line has a non-rectangular shape, wherein the transparent substrate has a plurality of non-planar structures, and a cross section of at least one of the plurality of non-planar structures has a shape of gradually decreasing width along a direction away from a surface of the transparent substrate.

2. The antenna according to claim 1, wherein the at least one non-planar structure is a concave structure or a convex structure.

3. The antenna according to claim 1, wherein the at least one metal line covers the at least one non-planar structure.

4. The antenna of claim 3, wherein the at least one metal line group comprises at least two metal lines, and spacing between adjacent metal lines in the at least one metal line group is greater than or equal to 0.2 microns.

5. The antenna according to claim 1, wherein the cross section of the at least one non-planar structure of the transparent substrate has a wedge-like shape, and the cross section of the at least one metal line has a shape of an epaulet.

6. The antenna according to claim 1, wherein a ratio of a maximum vertical distance between a surface of the at least one non-planar structure of the transparent substrate and the surface of the transparent substrate to a width of the at least one metal line is at least greater than 0.5.

7. The antenna of claim 1, wherein a maximum vertical distance between a surface of the at least one non-planar structure of the transparent substrate and the surface of the transparent substrate ranges from 2 microns to 25 microns, and a width of the at least one metal line ranges from 1 micron to 10 microns.

8. The antenna of claim 1, wherein the at least one metal line group comprises at least two metal lines, in a direction perpendicular to the transparent substrate, inclined directions of adjacent metal lines in the at least one metal line group are parallel to each other, and a projection of the at least one metal line in the at least one metal line group on the transparent substrate is at least partially overlapped with a projection of the at least one non-planar structure on the transparent substrate.

9. The antenna of claim 8, wherein a cross section of the at least one non-planar structure of the transparent substrate is V-shaped or inverted V-shaped, and a cross section of the at least one metal line has a shape of a parallelogram.

10. The antenna of claim 8, wherein spacing between adjacent metal lines in the at least one metal line group is greater than 1 micron.

11. The antenna of claim 1, further comprising an organic layer covering the metal layer.

12. The antenna of claim 1, wherein the transparent substrate is a glass substrate.

13. The antenna of claim 1, wherein the at least one hollow region has a rectangular shape, a rhombic shape or a polygonal shape.

14. An electronic device, comprising:

an antenna, wherein the antenna comprises:

a transparent substrate and a metal layer disposed on the transparent substrate;

the metal layer comprises a plurality of hollow regions, at least one hollow region in the plurality of hollow regions is surrounded by at least one metal line group, and the at least one metal line group comprises at least one metal line; a cross section of the at least one metal line has a non-rectangular shape, wherein the transparent substrate has a plurality of non-planar structures, and a cross section of at least one of the non-planar structures has a shape whose width gradually decreases along a direction away from a surface of the transparent substrate.

15. The electronic device of claim 14, wherein the at least one metal line group comprises at least two metal lines, in a direction perpendicular to the transparent substrate, inclined directions of adjacent metal lines in the at least one metal line group are parallel to each other, and a projection of the at least one metal line in the at least one metal line group on the transparent substrate is at least partially overlapped with a projection of the at least one non-planar structure on the transparent substrate.

16. A preparation method for an antenna, comprising:

providing a transparent substrate;

forming a metal layer on the transparent substrate, wherein the metal layer comprises a plurality of hollow regions, and at least one hollow region in the plurality of hollow regions is surrounded by at least one metal line group, the at least one metal line group comprises at least one metal line, and a cross section of the at least one metal line has a non-rectangular shape, wherein the transparent substrate is a glass substrate; and wherein providing a transparent substrate comprises etching a plurality of non-planar structures on the glass substrate in a mixed mode of dry etching and wet etching, wherein a cross section of at least one non-planar structure in the plurality of non-planar structures is in a shape of gradually decreasing width along a direction away from a surface of the transparent substrate.

17. The preparation method of claim 16, wherein forming the metal layer on the transparent substrate comprises:

depositing a metal thin film on a part of region of the at least one non-planar structure of the transparent substrate by use of a mask to form the metal layer, wherein the at least one metal line group of the metal layer comprises at least two metal lines, and inclined directions of adjacent metal lines in the at least one metal line group are parallel to each other on a direction perpendicular to the transparent substrate.

* * * * *